US009221648B2

(12) United States Patent
Sugiyama et al.

(10) Patent No.: US 9,221,648 B2
(45) Date of Patent: Dec. 29, 2015

(54) SHEET PROCESSING DEVICE, IMAGE FORMING SYSTEM, AND METHOD OF ADDITIONALLY FOLDING SHEET BUNDLE

(71) Applicants: Keisuke Sugiyama, Kanagawa (JP); Kiyoshi Hata, Tokyo (JP); Takeshi Akai, Kanagawa (JP); Ikuhisa Okamoto, Kanagawa (JP); Jun Yamada, Kanagawa (JP); Takao Watanabe, Kanagawa (JP); Akihiro Musha, Kanagawa (JP)

(72) Inventors: Keisuke Sugiyama, Kanagawa (JP); Kiyoshi Hata, Tokyo (JP); Takeshi Akai, Kanagawa (JP); Ikuhisa Okamoto, Kanagawa (JP); Jun Yamada, Kanagawa (JP); Takao Watanabe, Kanagawa (JP); Akihiro Musha, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/449,621

(22) Filed: Aug. 1, 2014

(65) Prior Publication Data

US 2015/0045197 A1 Feb. 12, 2015

(30) Foreign Application Priority Data

Aug. 12, 2013 (JP) ..... 2013-167889

(51) Int. Cl.
*B65H 45/18* (2006.01)
*B31F 1/00* (2006.01)
(Continued)

(52) U.S. Cl.
CPC *B65H 45/18* (2013.01); *B31F 1/00* (2013.01); *B31F 1/0006* (2013.01); *B31F 1/0035* (2013.01); *B65H 45/04* (2013.01); *B65H 45/12* (2013.01); *B65H 2301/51232* (2013.01); *B65H 2701/13212* (2013.01); *B65H 2801/27* (2013.01)

(58) Field of Classification Search
CPC ..... B31F 1/00; B31F 1/0006; B31F 1/0035; B65H 45/12; B65H 45/04; B65H 2801/27
USPC ..... 270/32, 45, 58.07
See application file for complete search history.

(56) References Cited

U.S. PATENT DOCUMENTS 8,500,111 B2 * 8/2013 Terao ..... 270/45
2006/0263174 A1 11/2006 Oikawa et al.
2012/0190526 A1 * 7/2012 Terao ..... 493/454
(Continued)

FOREIGN PATENT DOCUMENTS

EP 2634125 A1 * 9/2013
EP 2644547 A1 * 10/2013
(Continued)

OTHER PUBLICATIONS

U.S. Appl. No. 14/160,671, filed Jan. 22, 2014.

*Primary Examiner* — Leslie A Nicholson, III
(74) *Attorney, Agent, or Firm* — Oblon, McClelland, Maier & Neustadt, L.L.P.

(57) ABSTRACT

The present invention is concerning a sheet processing device comprising: a pressing unit that includes a first pressing roller arranged on one side of a thickness direction of a folded sheet bundle, and a second pressing roller and a third pressing roller arranged on the other side across a fold line part of the folded sheet bundle, and a moving unit that moves the pressing unit in a state in which each of a first line and a second line is not parallel to the thickness direction of the folded sheet bundle, the first line connecting the rotational center of the first pressing roller and the rotational center of the second pressing roller, and the second line connecting the rotational center of the first pressing roller and the rotational center of the third pressing roller.

10 Claims, 18 Drawing Sheets

(51) Int. Cl.
*B65H 45/12* (2006.01)
*B65H 45/04* (2006.01)

(56) References Cited

U.S. PATENT DOCUMENTS

| | | | |
|---|---|---|---|
| 2013/0210036 | A1 | 8/2013 | Kanaley et al. |
| 2014/0187407 | A1 | 7/2014 | Kikuchi et al. |
| 2014/0203486 | A1 | 7/2014 | Sugiyama et al. |
| 2014/0203488 | A1 | 7/2014 | Hidaka et al. |
| 2014/0206516 | A1 | 7/2014 | Hata et al. |
| 2014/0206519 | A1 | 7/2014 | Hoshino et al. |

FOREIGN PATENT DOCUMENTS

| | | | |
|---|---|---|---|
| JP | 2009-126685 | | 6/2009 |
| JP | 4448059 | | 1/2010 |
| JP | 2012153530 A | * | 8/2012 |
| JP | 2013-148586 | | 8/2013 |

* cited by examiner

SHEET PROCESSING DEVICE, IMAGE FORMING SYSTEM, AND METHOD OF ADDITIONALLY FOLDING SHEET BUNDLE

CROSS-REFERENCE TO RELATED APPLICATIONS

The present application claims priority to and incorporates by reference the entire contents of Japanese Patent Application No. 2013-167889 filed in Japan on Aug. 12, 2013.

BACKGROUND OF THE INVENTION

1. Field of the Invention

The present invention relates to a sheet processing device, an image forming system, and a method of additionally folding a sheet bundle, and specifically relates to a sheet processing device having a function for folding a sheet recording medium such as paper, recording paper, and transfer paper (hereinafter, simply referred to as a "sheet" in this specification), an image forming system including the sheet processing device, and a method of additionally folding a sheet bundle performed by the sheet processing device.

2. Description of the Related Art

Conventionally, in some postprocessing devices used in combination with an image forming apparatus such as a copying machine, center parts of one or more sheets are stitched and the center part of the sheet bundle is folded with a pair of folding rollers arranged in parallel in a sheet folding direction to bind a saddle-stitched booklet. Already known is a technique for additional-folding with a roller moving along a spine of the booklet to reinforce a fold of the saddle-stitched booklet.

In such an additional-folding technique, a roller waiting outside the booklet (sheet bundle) is moved on the spine (fold line part) of the booklet to additionally fold the spine of the booklet with an additional-folding roller.

As such kind of additional-folding technique, known is the invention disclosed in Japanese Patent Application Laid-open No. 2009-126685 or Japanese Patent Application Laid-open No. 2006-321622, for example.

Japanese Patent Application Laid-open No. 2009-126685 discloses a sheet folding device including a folding unit that folds a carried sheet-like recording medium, and an additional-folding unit that moves and pressurizes on a fold line part of the sheet recording medium in a direction orthogonal to a sheet carrying direction to perform additional-folding after the folding processing by the folding unit. In the sheet folding device, the additional-folding unit is arranged to be inclined in a direction in which a force is generated in a moving direction when the fold line part is pressurized with respect to a normal on a medium surface of the sheet recording medium.

Japanese Patent Application Laid-open No. 2006-321622 discloses a sheet bundle spine processing device including a fold processing unit that moves while pinching front and rear surfaces of a spine fold line part of a folded sheet bundle to arrange the shape of the fold line part, a spine processing unit that moves while pressing a spine of the spine fold line part of the sheet bundle to flatten the spine, and a selection unit that selects and activates at least one of the fold processing unit and the spine processing unit.

In the technique disclosed in Japanese Patent Application Laid-open No. 2009-126685, although a direction of an energizing force is inclined from a moving direction of an additional-folding mechanism in order to reduce a load, the additional-folding mechanism is configured by a fixed receiving member opposed to a pressure roller, so that a pressing force to a sheet bundle is generated in the thickness direction of the sheet bundle. Due to this, rigidity is required for the device, the size of the device is increased, and the cost is increased accordingly.

In the technique disclosed in Japanese Patent Application Laid-open No. 2006-321622, a fold processing unit for reinforcing a fold line part includes three or more additional-folding rollers. The fold processing unit including a pair of two rollers for reinforcing the fold line part generates a pressurizing force in a direction orthogonal to a moving direction, and the third roller for flattening the spine of the fold line part generates the pressurizing force in a direction orthogonal to the pressurizing force generated by the pair of two rollers in a sheet carrying direction. Due to this, similarly to the technique disclosed in Japanese Patent Application Laid-open No. 2009-126685, rigidity is required for the device, the size of the device is increased, and the cost is increased accordingly.

In view of the conventional arts, there is a need to enable the additional-folding with a small pressurizing force, and reduce the size and cost of the device.

SUMMARY OF THE INVENTION

It is an object of the present invention to at least partially solve the problems in the conventional technology.

According to the present invention, there is provided a sheet processing device comprising: a pressing unit that presses a fold line part of a folded sheet bundle; and a moving unit that moves a pressing position of the pressing unit in a fold direction of the folded sheet bundle, wherein the pressing unit includes a first pressing roller arranged on one side of a thickness direction of the folded sheet bundle, and a second pressing roller and a third pressing roller arranged on the other side across the fold line part of the folded sheet bundle, and the pressing unit is arranged in a state in which each of a first line and a second line is not parallel to the thickness direction of the folded sheet bundle, the first line connecting the rotational center of the first pressing roller and the rotational center of the second pressing roller, and the second line connecting the rotational center of the first pressing roller and the rotational center of the third pressing roller.

The present invention also provides an image forming system including a sheet processing device, wherein the sheet processing device comprises; a pressing unit that presses a fold line part of a folded sheet bundle, a moving unit that moves a pressing position of the pressing unit in a fold direction of the folded sheet bundle, and the pressing unit includes a first pressing roller arranged on one side of a thickness direction of the folded sheet bundle, and a second pressing roller and a third pressing roller arranged on the other side across the fold line part of the folded sheet bundle, and the pressing unit is arranged in a state in which each of a first line and a second line is not parallel to the thickness direction of the folded sheet bundle, the first line connecting the rotational center of the first pressing roller and the rotational center of the second pressing roller, and the second line connecting the rotational center of the first pressing roller and the center of the third pressing roller.

The present invention also provides a method of additionally folding a folded sheet bundle, comprising: arranging a first pressing roller on one side of a thickness direction of the folded sheet bundle, and arranging a second pressing roller and a third pressing roller on the other side of the thickness direction of the folded sheet bundle; holding a fold line part of the folded sheet bundle between the first pressing roller and the second and the third pressing rollers; and moving the first, the second, and the third pressing rollers in a fold direction of the folded sheet bundle to additionally fold the fold line part of the folded sheet bundle in a state in which each of a first line and a second line is not parallel to the thickness direction of the folded sheet bundle, the first line connecting the rotational center of the first pressing roller and the center of the second pressing roller, and the second line connecting the rotational center of the first pressing roller and the center of the third pressing roller.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 28(*b*) is a diagram illustrating the positional relation between the upper additional-folding roller and the first and the second lower additional-folding rollers when the sheet bundle is weakly bent;

DETAILED DESCRIPTION OF THE PREFERRED EMBODIMENTS

According to the present invention, in that an additional-folding roller moves in a sheet width direction of a saddle-stitched booklet to additionally fold a spine of the booklet, additional-folding processing is characteristically performed while holding a sheet with three additional-folding rollers and causing mountain-shaped deformation of the sheet.

The following describes an embodiment of the present invention with reference to the drawings.

Figure 1:
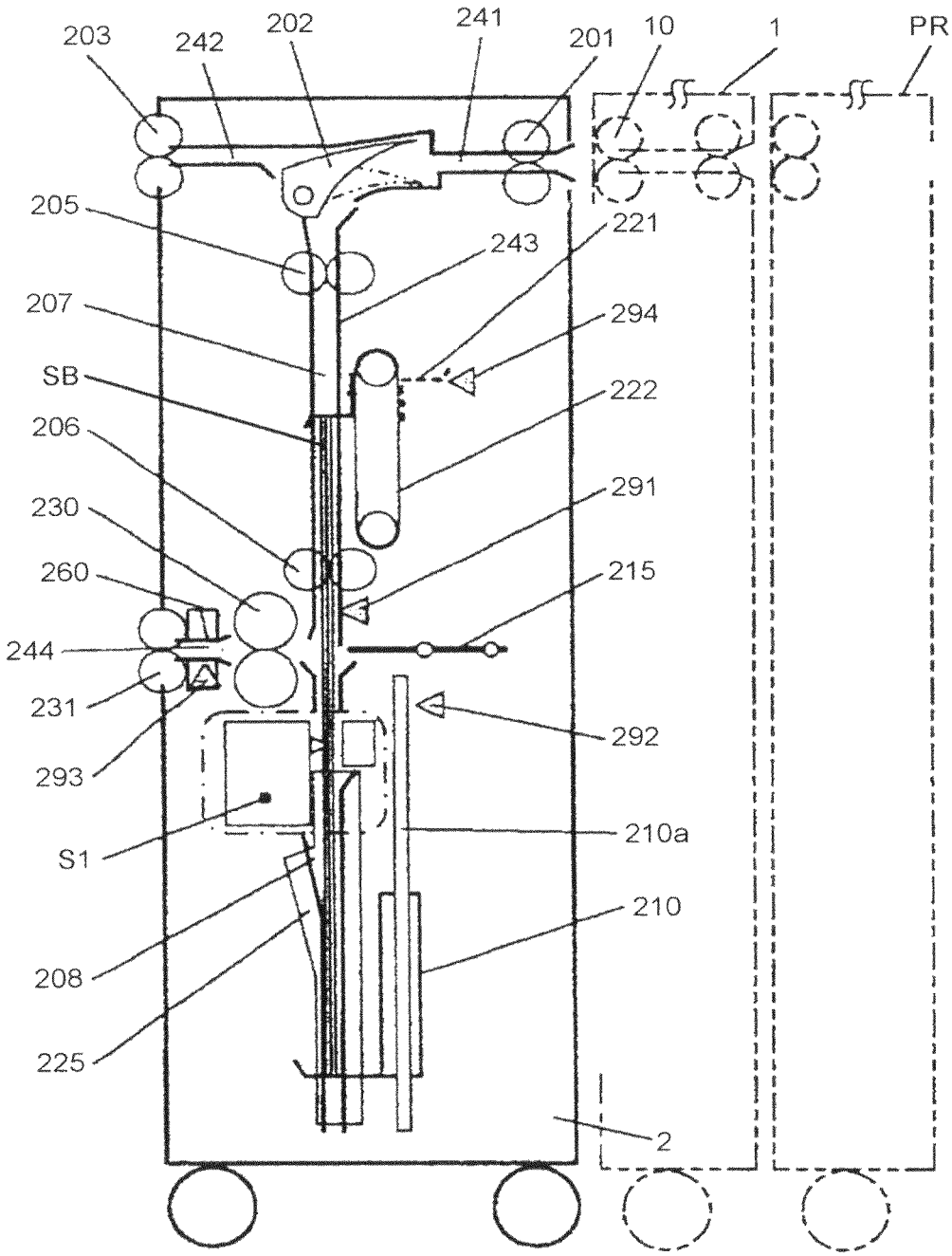
FIG. 1 is a diagram illustrating a system configuration of an image processing system including an image forming apparatus and a plurality of sheet processing devices according to an embodiment of the present invention.

FIG. 1 is a diagram illustrating a system configuration of an image processing system including an image forming apparatus and a plurality of sheet processing devices according to the embodiment. In the embodiment, first and second sheet postprocessing devices 1 and 2 are coupled to a rear stage of an image forming apparatus PR in this order.

The first sheet postprocessing device 1 is a sheet postprocessing device having a function of preparing a sheet bundle for receiving sheets one by one from the image forming apparatus PR, overlapping and adjusting the sheets successively, and preparing the sheet bundle at a stack part. The first sheet postprocessing device 1 discharges the sheet bundle from a sheet bundle discharge roller 10 to the second sheet postprocessing device 2 at the rear stage. The second sheet postprocessing device 2 is a saddle-stitch bookbinding device that receives the carried sheet bundle and performs saddle-stitching and center-folding (herein, the second sheet postprocessing device is also referred to as a saddle-stitch bookbinding device).

The saddle-stitch bookbinding device 2 discharges the bound booklet (sheet bundle) as it is, or discharges it to a sheet processing device at the rear stage. The image forming apparatus PR forms a visible image on a sheet recording medium based on input image data or image data of a read image. Examples of the image forming apparatus PR include a copying machine, a printer, a facsimile, or a digital multifunction peripheral having at least two functions thereof. The image forming apparatus PR may employ a known method such as an electrophotographic method and a droplet injection method. Any image forming method may be employed.

As illustrated in FIG. 1, the saddle-stitch bookbinding device 2 includes an inlet carrying path 241, a sheet-through carrying path 242, and a center-folding carrying path 243. An inlet roller 201 is arranged on the most upstream part in a sheet carrying direction of the inlet carrying path 241, and the aligned sheet bundle is carried in the device from the sheet bundle discharge roller 10 of the first sheet postprocessing device 1. In the following description, an upstream side in the sheet carrying direction is simply referred to as an upstream side, and a downstream side in the sheet carrying direction is simply referred to as a downstream side.

A bifurcating claw 202 is arranged on the downstream side of the inlet roller 201 of the inlet carrying path 241. The bifurcating claw 202 is arranged in the horizontal direction of the figure, and bifurcates the carrying direction of the sheet bundle into the sheet-through carrying path 242 or the center-folding carrying path 243. The sheet-through carrying path 242 is a carrying path that horizontally extends from the inlet carrying path 241 and guides the sheet bundle to a processing device (not illustrated) on the rear stage or a paper discharge tray. The sheet bundle is discharged to the rear stage by an upper paper discharge roller 203. The center-folding carrying path 243 is a carrying path that extends vertically downward from the bifurcating claw 202 and performs saddle-stitching and center-folding processing on the sheet bundle.

The center-folding carrying path 243 includes a bundle carrying upper guide plate 207 that guides the sheet bundle above a folding plate 215 for center-folding, and a bundle carrying lower guide plate 208 that guides the sheet bundle below the folding plate 215. The bundle carrying upper guide plate 207 includes a bundle carrying upper roller 205, a rear-end hitting claw 221, and a bundle carrying lower roller 206 arranged thereon in order from the upper part. The rear-end hitting claw 221 is erected on a rear-end hitting claw driving belt 222 driven by a driving motor (not illustrated). The rear-end hitting claw 221 hits (presses) the rear end of the sheet bundle SB toward a movable fence described later due to a reciprocative rotation operation of a rear-end hitting claw driving belt 222 to perform an aligning operation of the sheet bundle SB. When the sheet bundle SB is carried in, and when the sheet bundle SB is moved up for center-folding, the rear-end hitting claw 221 is retracted from the center-folding carrying path 243 of the bundle carrying upper guide plate 207 (position represented by a dashed line in FIG. 1).

Reference numeral 294 denotes a rear-end hitting claw HP sensor for detecting a home position of the rear-end hitting claw 221, which detects, as the home position, the position represented by the dashed line in FIG. 1 (position represented by a solid line in FIG. 2) after that the rear-end hitting claw 221 retracted from the center-folding carrying path 243. The rear-end hitting claw 221 is controlled based on the home position.

The bundle carrying lower guide plate 208 includes a saddle-stitching stapler S1, a saddle-stitching jogger fence 225, and a movable fence 210 arranged thereon in order from the upper part. The bundle carrying lower guide plate 208 is a guide plate that receives the sheet bundle SB carried through the bundle carrying upper guide plate 207. A pair of the saddle-stitching jogger fences 225 is arranged in the width direction, and in the lower part, the movable fence 210 on which a front end of the sheet bundle SB abuts (by which the front end of the sheet bundle SB is supported) is arranged in a vertically movable manner.

The saddle-stitching stapler S1 is a stapler that stitches the center part of the sheet bundle SB. The movable fence 210 moves in the vertical direction while supporting the front end of the sheet bundle SB, and positions the center position of the sheet bundle SB at a position opposed to the saddle-stitching stapler S1. At this position, staple processing, that is, the saddle-stitching is performed. The movable fence 210 is supported by a movable fence driving mechanism 210*a* and movable from a position of a movable fence HP sensor 292 illustrated in the upper part of the figure to the lowermost position. A movable range of the stroke of the movable fence 210 on which the front end of the sheet bundle abuts is secured so as to be able to process the maximum size and the minimum size that can be processed by the saddle-stitch bookbinding device 2. For example, a rack and pinion mechanism is used as the movable fence driving mechanism 210*a*.

The folding plate 215, a pair of folding rollers 230, an additional-folding roller unit 260, and a lower paper discharge roller 231 are arranged between the bundle carrying upper guide plate 207 and the bundle carrying lower guide plate 208, that is, substantially at the center part of the center-folding carrying path 243. The additional-folding roller unit 260 is configured such that the additional-folding rollers are arranged on upper and lower sides of a paper discharge carrying path between the pair of folding rollers 230 and the lower paper discharge roller 231. The folding plate 215 can reciprocate in the horizontal direction of the figure. A nip of the pair of folding rollers 230 is positioned in an operating direction of folding-operation, and a paper discharge carrying path 244 is arranged on the extended line therefrom. The lower paper discharge roller 231 is arranged on the most downstream side of the paper discharge carrying path 244, and discharges a folded sheet bundle to the rear stage.

A sheet bundle detecting sensor 291 is arranged on the lower end of the bundle carrying upper guide plate 207, and detects the front end of the sheet bundle SB that is carried in the center-folding carrying path 243 and passes through the center-folding position. A fold line part passage sensor 293 is arranged on the paper discharge carrying path 244, detects the front end of the center-folded sheet bundle SB, and recognizes passage of the center-folded sheet bundle SB.

Generally, as illustrated in the operation explanatory diagrams of FIG. 2 to FIG. 6, a saddle-stitching operation and a center-folding operation are performed in the saddle-stitch bookbinding device 2 that is configured as illustrated in FIG. 1. That is, when saddle-stitching and center-folding are selected in an operation panel (not illustrated) of the image forming apparatus PR, the sheet bundle for which saddle-stitching and center-folding are selected is guided toward the center-folding carrying path 243 due to counterclockwise deviation of the bifurcating claw 202. The bifurcating claw 202 is driven by a solenoid. Alternatively, the bifurcating claw 202 may be driven by a motor instead of the solenoid.

Figure 2:
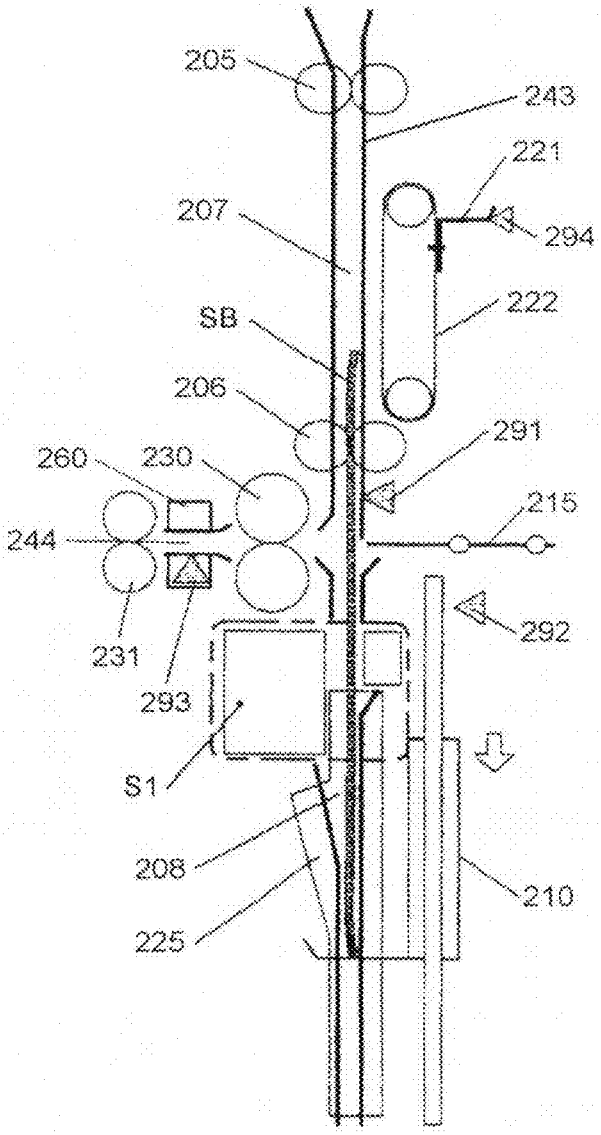
FIG. 2 is an operation explanatory diagram of a saddle-stitch bookbinding device illustrating a state of a sheet bundle when carried in a center-folding carrying path.

A sheet bundle SB carried in the center-folding carrying path 243 is carried downward in the center-folding carrying path 243 by the inlet roller 201 and the bundle carrying upper roller 205. After passage thereof is checked by the sheet bundle detecting sensor 291, the bundle carrying lower roller 206 carries the sheet bundle SB to a position at which the front end of the sheet bundle SB abuts on the movable fence 210 as illustrated in FIG. 2. At this time, the movable fence 210 stands by at different stop positions corresponding to sheet size information from the image forming apparatus PR, that is, information about a size in the carrying direction of each sheet bundle SB herein. In this case, in FIG. 2, the bundle carrying lower roller 206 holds the sheet bundle SB with the nip, and the rear-end hitting claw 221 stands by at the home position.

Figure 3:
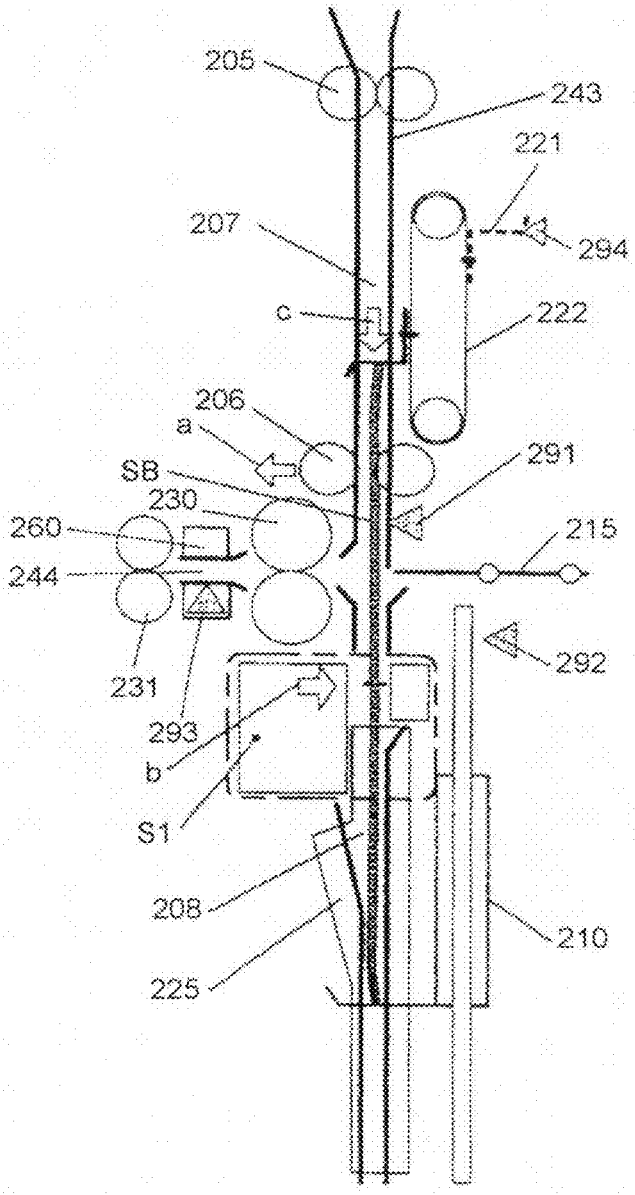
FIG. 3 is an operation explanatory diagram of the saddle-stitch bookbinding device illustrating a state of the sheet bundle during saddle stitching.

In this state, as illustrated in FIG. 3, holding pressure of the bundle carrying lower roller 206 is released (in a direction of the arrow a), the front end of the sheet bundle abuts on the movable fence 210, and the sheet bundle is stacked in a state in which the rear end thereof is free. Accordingly, the rear-end hitting claw 221 is driven. Due to this driving, the rear end of the sheet bundle SB is hit by the rear-end hitting claw 221 and final alignment is performed in the carrying direction (in a direction of the arrow c).

Subsequently, the saddle-stitching jogger fence 225 performs an aligning operation in the width direction (direction orthogonal to a sheet carrying direction), and the movable fence 210 and the rear-end hitting claw 221 perform an aligning operation in the carrying direction. Accordingly, an adjusting operation of the sheet bundle SB in the width direction and the carrying direction is completed. In this case, a pushing amount of each of the rear-end hitting claw 221 and the saddle-stitching jogger fence 225 is changed and adjusted to an optimal value corresponding to size information of the sheet, information about the number of sheets of the sheet bundle, and thickness information of the sheet bundle.

Space in the carrying path is reduced when the bundle is thick, so that the sheet bundle cannot be completely adjusted in single adjusting operation in many cases. In such a case, the number of aligning operations is increased. Due to this, a better adjusted state can be achieved. Time required for sequentially overlapping the sheets on the upstream side is increased as the number of sheets increases, so that time until the next sheet bundle SB is received is prolonged. As a result, there is no time loss as a system even when the number of adjusting operations is increased, so that a good adjusted state can be efficiently achieved. Accordingly, the number of adjusting operations can be controlled depending on processing time on the upstream side.

A standby position of the movable fence 210 is normally set so that a saddle stitching position of the sheet bundle SB is opposed to a stitching position of the saddle-stitching stapler S1. This is because, when the adjusting operation is performed at this position, stitching processing can be directly performed at a stacked position without moving the movable fence 210 to the saddle stitching position of the sheet bundle SB. At this standby position, a stitcher of the saddle-stitching stapler S1 is driven in a direction of the arrow b at the center part of the sheet bundle SB, stitching processing is performed between the stitcher and a clincher, and the sheet bundle SB is saddle-stitched.

The movable fence 210 is positioned by pulse control from the movable fence HP sensor 292, and the rear-end hitting claw 221 is positioned by pulse control from the rear-end hitting claw HP sensor 294. Positioning control of the movable fence 210 and the rear-end hitting claw 221 is performed by a central processing unit (CPU) of a control circuit (not illustrated) of the saddle-stitch bookbinding device 2.

Figure 4:
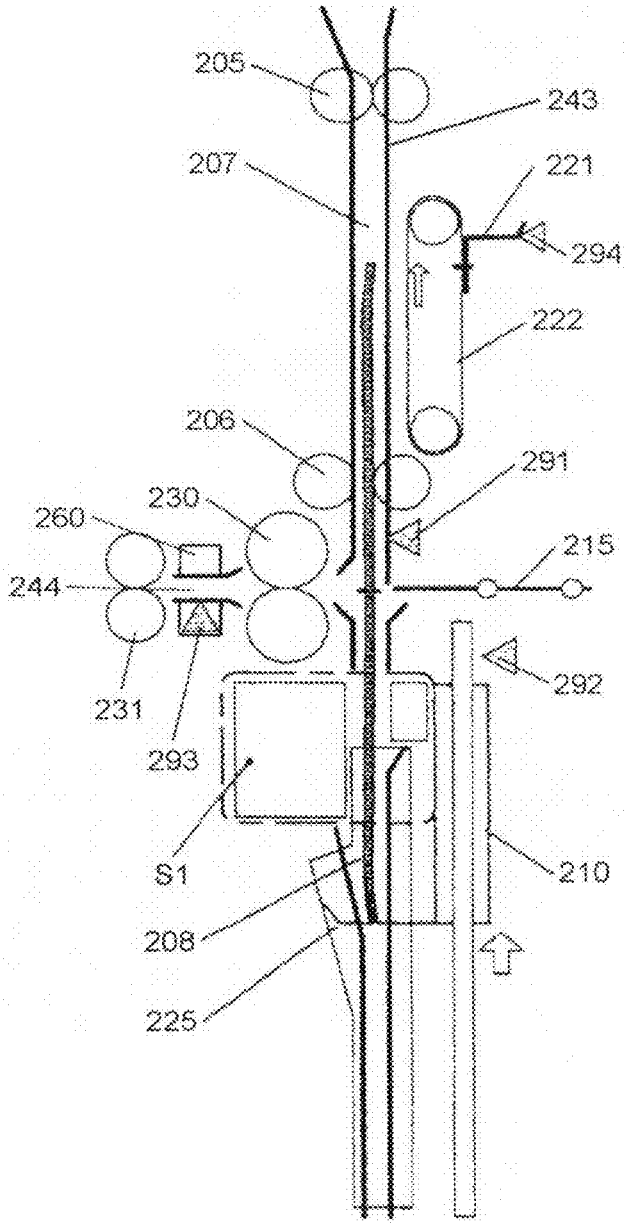
FIG. 4 is an operation explanatory diagram of the saddle-stitch bookbinding device illustrating a state in which the sheet bundle is completely moved to a center-folding position.

The sheet bundle SB saddle-stitched in the state of FIG. 3 is transferred, as illustrated in FIG. 4, to a position where the saddle stitching position (center position in the carrying direction of the sheet bundle SB) is opposed to the folding plate 215 corresponding to upward movement of the movable fence 210 in a state in which pressurization by the bundle carrying lower roller 206 is released. This position is also controlled based on a detection position of the movable fence HP sensor 292.

Figure 5:
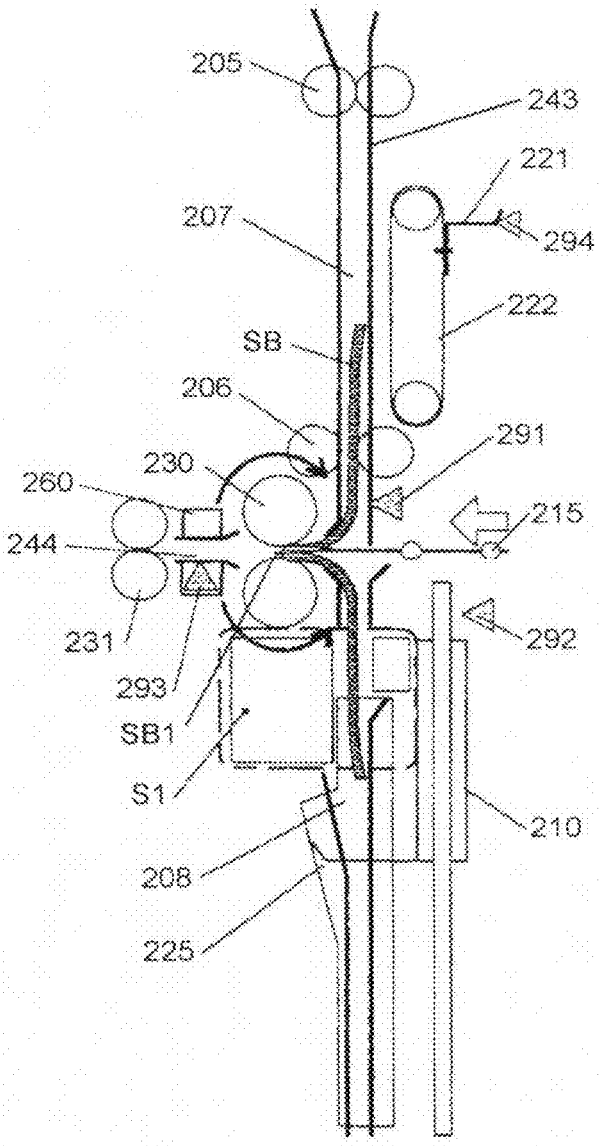
FIG. 5 is an operation explanatory diagram of the saddle-stitch bookbinding device illustrating a state in which center-folding processing is performed on the sheet bundle.

When the sheet bundle SB reaches the position of FIG. 4, as illustrated in FIG. 5, the folding plate 215 moves in a nip direction of the pair of folding rollers 230, abuts on the sheet bundle SB in the vicinity of a stapled portion thereof from a substantially orthogonal direction, and pushes out the sheet bundle SB to the nip side. The sheet bundle SB is pushed by the folding plate 215, guided to the nip of the pair of folding rollers 230, and pushed in the nip of the pair of folding rollers 230 that has been rotated in advance. The pair of folding rollers 230 pressurizes and carries the sheet bundle SB pushed in the nip. With this pressurizing and carrying operation, the center of the sheet bundle SB is folded and a simply bound sheet bundle SB is formed. FIG. 5 illustrates a state in which the front end of a fold line part SB1 of the center-folded sheet bundle SB is held and pressurized by the nip of the pair of folding rollers 230.

Figure 6:
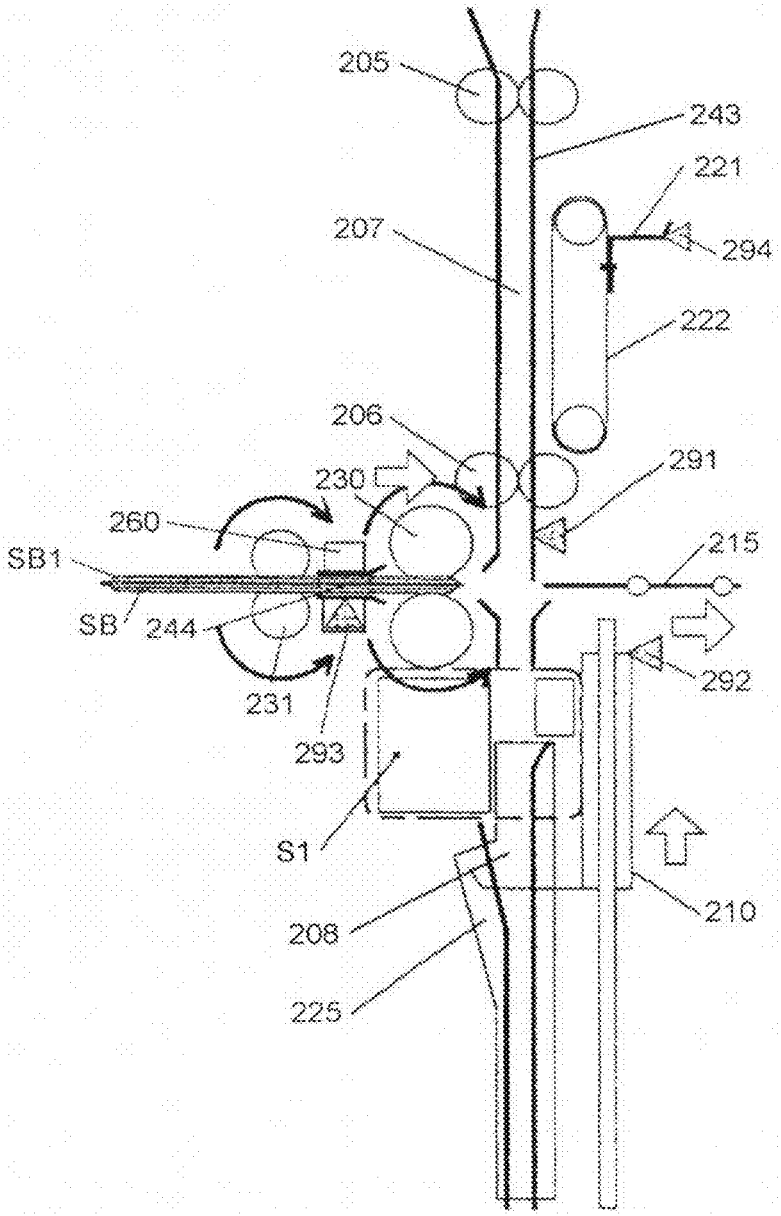
FIG. 6 is an operation explanatory diagram of the saddle-stitch bookbinding device illustrating a state of the sheet bundle discharged after the center-folding is finished.

The sheet bundle SB folded in two at the center part in the state of FIG. 5 is carried by the pair of folding rollers 230 as the center-folded sheet bundle SB as illustrated in FIG. 6, held by the lower paper discharge roller 231, and discharged to the rear stage. In this case, when the rear end of the center-folded sheet bundle SB is detected by the fold line part passage sensor 293, the folding plate 215 and the movable fence 210 are returned to the home position and the bundle carrying lower roller 206 is returned to the pressurizing state to prepare for the next sheet bundle SB to be carried in. When the size and the number of sheets of the next job are the same, the movable fence 210 may move to the position of FIG. 2 again to stand by. These control processes are also performed by the CPU of the control circuit.

Figure 7:
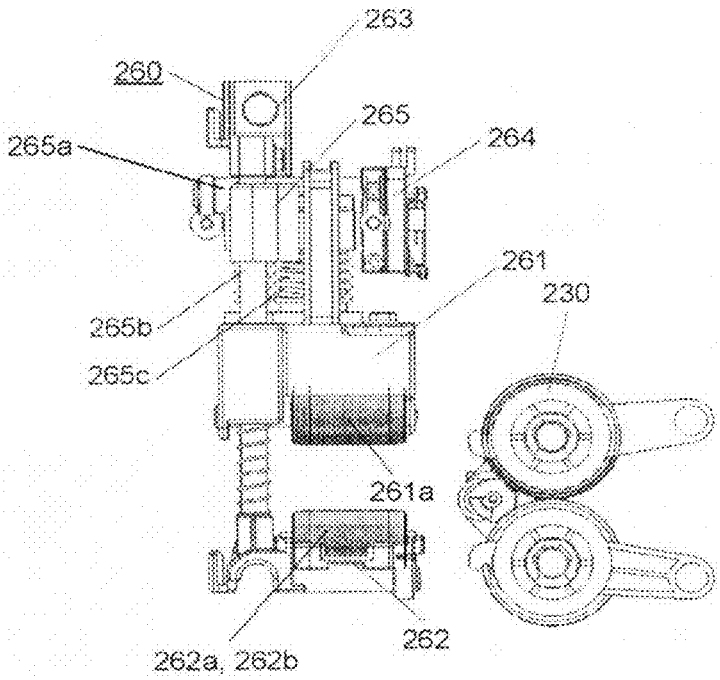
FIG. 7 is a front view of a principal part illustrating an additional-folding roller unit and a pair of folding rollers.
Figure 8:
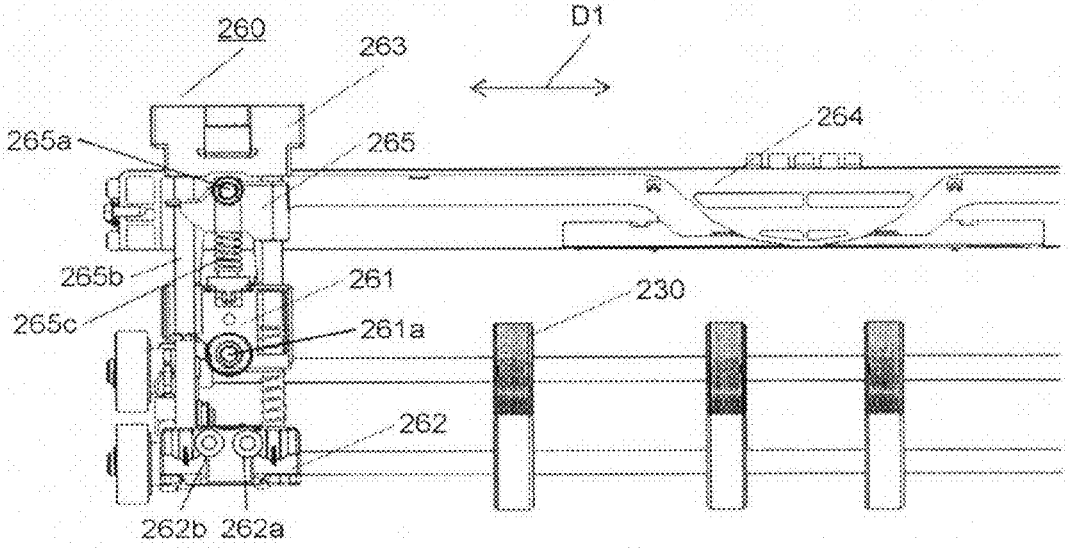
FIG. 8 is a side view of the principal part viewed from the left side of FIG. 7.

FIG. 7 is a front view of a principal part illustrating a basic configuration of the additional-folding roller unit and the pair of folding rollers, and FIG. 8 is a side view of the principal part viewed from the left side of FIG. 7. The additional-folding roller unit 260 is arranged in the paper discharge carrying path 244 between the pair of folding rollers 230 and the lower paper discharge roller 231, and includes a unit moving mechanism 263, a guide member 264, and a pressing mechanism 265. The unit moving mechanism 263 reciprocates the additional-folding roller unit 260 in the depth direction of the figure (direction orthogonal to the sheet carrying direction) along the guide member 264 with a driving source and a driving mechanism (not illustrated). The pressing mechanism 265 is a mechanism that applies a pressure in the vertical direction to press the sheet bundle SB, and includes an upper additional-folding roller unit 261 and a lower additional-folding roller unit 262.

The upper additional-folding roller unit 261 is supported by the unit moving mechanism 263 with a support member 265*b* to be movable in the vertical direction, and the lower additional-folding roller unit 262 is mounted to the lower end of the support member 265*b* of the pressing mechanism 265 so as not to be movable. The upper additional-folding roller 261*a* of the upper additional-folding roller unit 261 can be in press-contact with the first and the second lower additional-folding rollers 262*a* and 262*b*, and the center-folded sheet bundle SB is held and pressurized in the nip configured by the three rollers. The pressurizing force is given by a pressurizing spring (an energizing unit) 265*c* that pressurizes the upper additional-folding roller unit 261 with an elastic force. The upper additional-folding roller unit 261 moves in the width direction (direction of the arrow D1 in FIG. 8) of the center-folded sheet bundle SB as described later in the pressurized state, and performs additional-folding on the fold line part SB1.

Figure 9:
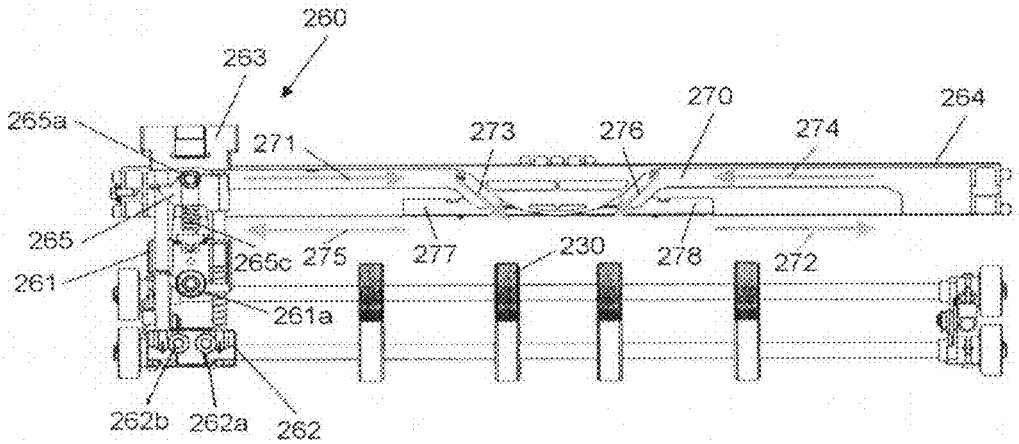
FIG. 9 is a diagram illustrating details about a guide member.

FIG. 9 is a diagram illustrating details about the guide member 264. The guide member 264 includes a guiding path 270 that guides the additional-folding roller unit 260 in the width direction of the center-folded sheet bundle SB. Six paths are set in the guiding path 270 as follows:

1) a first guiding path 271 that guides the pressing mechanism 265 in a press-releasing state in forward movement;

2) a second guiding path 272 that guides the pressing mechanism 265 in a pressing state in forward movement;

3) a third guiding path 273 that switches the pressing mechanism 265 from the press-releasing state to the pressing state in forward movement;

4) a fourth guiding path 274 that guides the pressing mechanism 265 in the press-releasing state in backward movement;

5) a fifth guiding path 275 that guides the pressing mechanism 265 in the pressing state in backward movement; and 6) a sixth guiding path 276 that switches the pressing mechanism 265 from the press-releasing state to the pressing state in backward movement.

Figure 10:
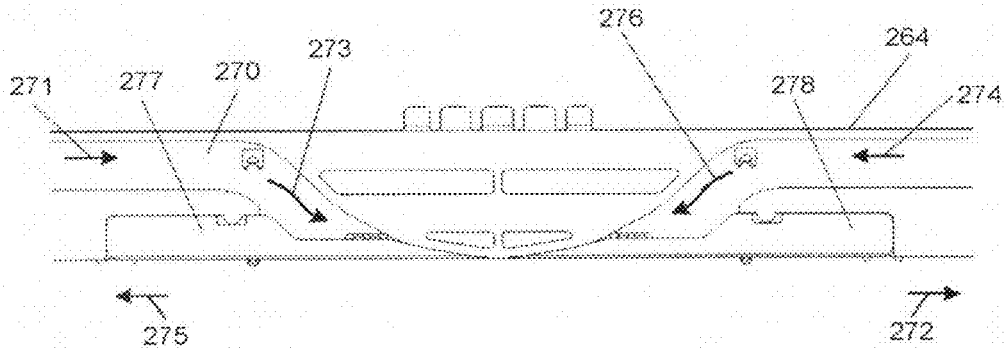
FIG. 10 is an enlarged view of the principal part of FIG. 9 illustrating a state in which a path switching claw is not switched.
Figure 11:
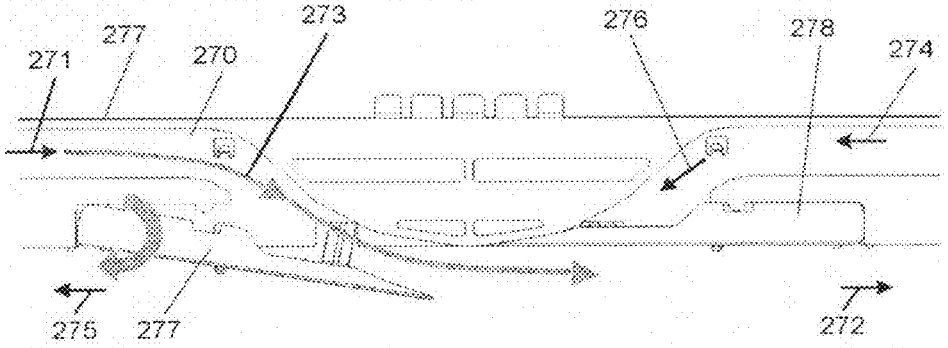
FIG. 11 is an enlarged view of the principal part of FIG. 9 illustrating a state in which a first path switching claw is switched.

FIG. 10 and FIG. 11 are enlarged views of the principal part of FIG. 9. As illustrated in FIG. 10 and FIG. 11, a first path switching claw 277 is arranged at an intersection point between the third guiding path 273 and the second guiding path 272, and a second path switching claw 278 is arranged at an intersection point between the sixth guiding path 276 and the fifth guiding path 275. As illustrated in FIG. 11, the first path switching claw 277 can switch the third guiding path 273 to the second guiding path 272, and the second path switching claw 278 can switch the sixth guiding path 276 to the fifth guiding path 275. However, in the former case, the second guiding path 272 cannot be switched to the third guiding path 273. In the latter case, the fifth guiding path 275 cannot be switched to the sixth guiding path 276. That is, switching cannot be performed in a reverse direction. An arrow in FIG. 11 represents a movement track of a guide pin 265*a*.

The pressing mechanism 265 moves along the guiding path 270 because the guide pin 265*a* of the pressing mechanism 265 is movably engaged in the guiding path 270 in a loosely fitted state. That is, the guiding path 270 functions as a cam groove, and the guide pin 265*a* functions as a cam follower to be displaced while moving along the cam groove.

FIG. 12 to FIG. 22 are operation explanatory diagrams of the additional-folding operation by the additional-folding roller unit 260 according to the embodiment.

Figure 12:
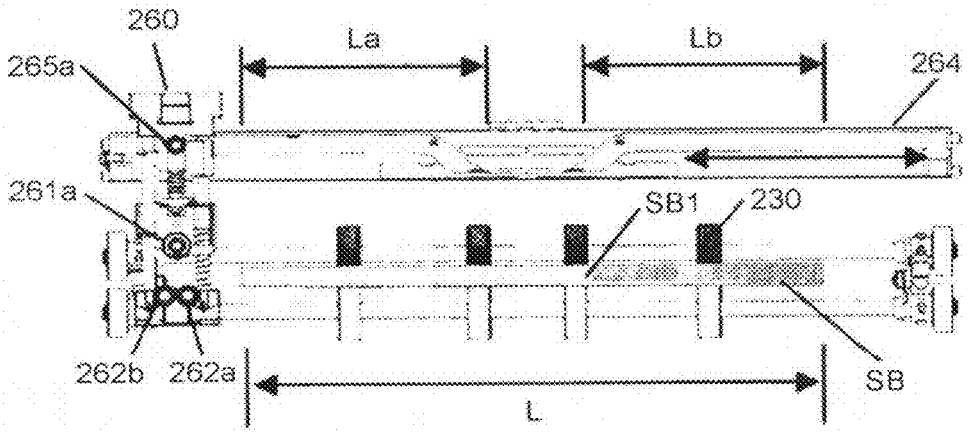
FIG. 12 is an operation explanatory diagram illustrating an initial state of an additional-folding operation.

FIG. 12 illustrates a state in which the sheet bundle SB center-folded folded by the pair of folding rollers 230 is carried and stopped at an additional-folding position set in advance, and the additional-folding roller unit 260 is at a standby position. This state is an initial position of the additional-folding operation.

Figure 13:
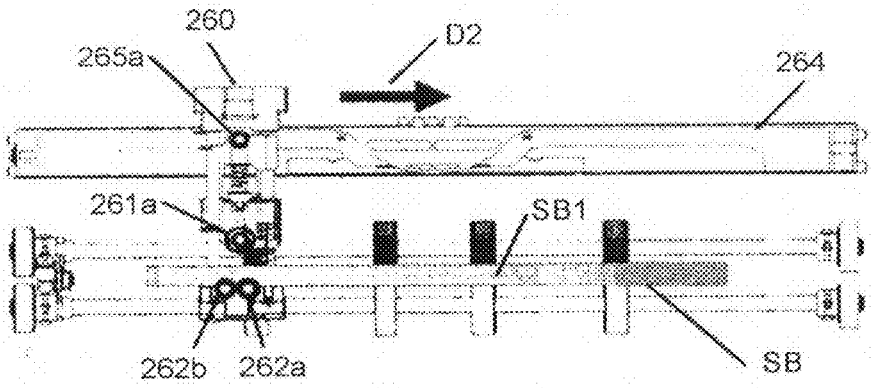
FIG. 13 is an operation explanatory diagram illustrating a state in which forward movement of the additional-folding roller unit is started.
Figure 14:
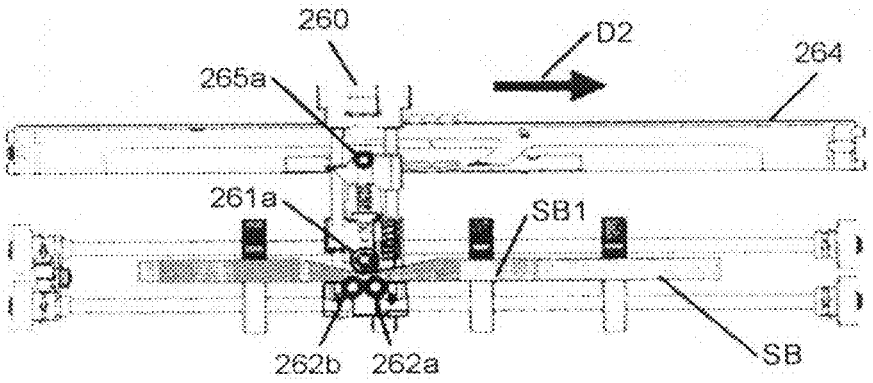
FIG. 14 is an operation explanatory diagram illustrating a state in which the additional-folding roller unit comes to a third guiding path near the center part of the sheet bundle.

The additional-folding roller unit 260 starts to move forward in the right direction of the figure (direction of the arrow D2) from the initial position (FIG. 12) (FIG. 13). In this case, the pressing mechanism 265 in the additional-folding roller unit 260 moves along the guiding path 270 of the guide member 264 due to action of the guide pin 265*a*. The pressing mechanism 265 moves along the first guiding path 271 immediately after the operation start. At this time, the first and the second lower additional-folding rollers 262*a* and 262*b* are in the press-releasing state with respect to the upper additional-folding roller 261*a*. The press-releasing state means a state in which the upper additional-folding roller 261*a*, the first and the second lower additional-folding rollers 262*a* and 262*b*, and the center-folded sheet bundle SB are in contact with each other but little pressure is applied thereto, or a state in which the upper additional-folding roller 261*a*, the first and the second lower additional-folding rollers 262*a* and 262*b*, and the center-folded sheet bundle SB are separated from each other.

Figure 15:
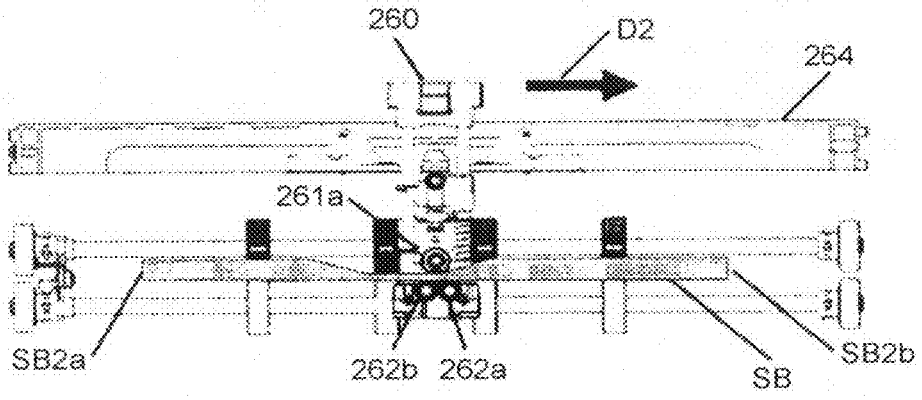
FIG. 15 is an operation explanatory diagram illustrating a state in which the additional-folding roller unit pushes aside the first path switching claw and enters a second guiding path.

When coming to the third guiding path 273 near the center of the center-folded sheet bundle SB (FIG. 14), the pressing mechanism 265 starts to descend along the third guiding path 273, pushes aside the first path switching claw 277, and enters the second guiding path 272 (FIG. 15). At this time, the pressing mechanism 265 is in a state of pressing the upper additional-folding roller unit 261, and the upper additional-folding roller unit 261 abuts on the center-folded sheet bundle SB to be in a pressing state.

Figure 16:
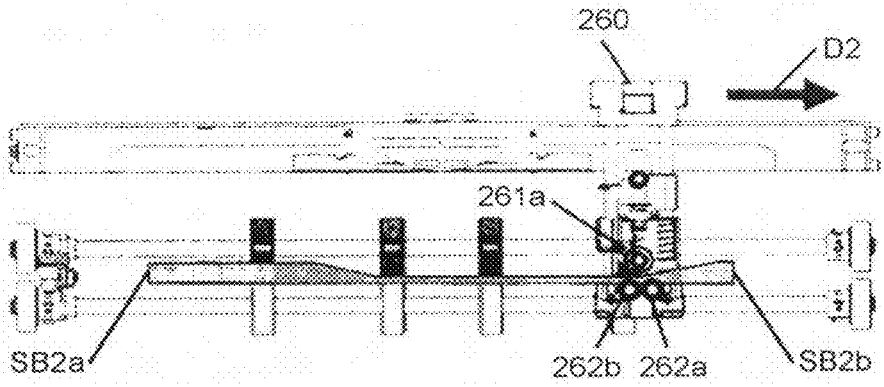
FIG. 16 is an operation explanatory diagram illustrates a state in which the additional-folding roller unit moves in an end direction while pressing the sheet bundle.
Figure 17:
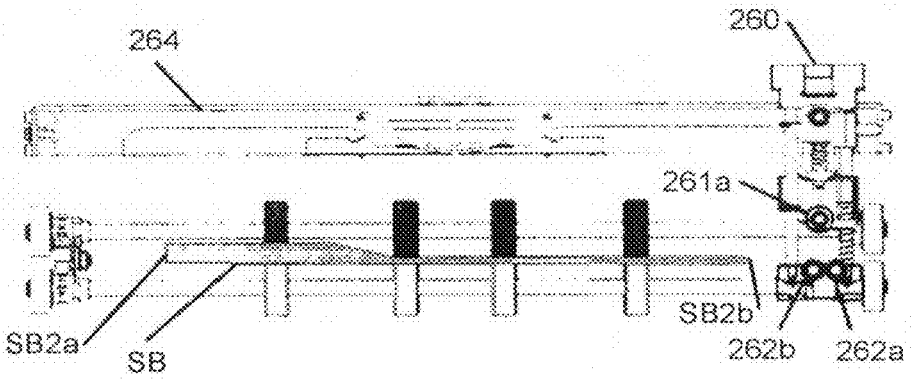
FIG. 17 is an operation explanatory diagram illustrating a state in which the additional-folding roller unit moves to a final position of the forward movement along the second guiding path.

The additional-folding roller unit 260 further moves in the direction of the arrow D2 while keeping the pressing state (FIG. 16). Because the second path switching claw 278 cannot move in the reverse direction, the additional-folding roller unit 260 moves along the second guiding path 272 without being guided to the sixth guiding path 276, passes through the center-folded sheet bundle SB, and reaches the final position of the forward movement (FIG. 17). After moving to this position, the guide pin 265*a* of the pressing mechanism 265 is moved from the second guiding path 272 to the upper fourth guiding path 274. As a result, position regulation of the guide pin 265*a* by an upper surface of the second guiding path 272 is released, so that the upper additional-folding roller 261*a* moves away from the first and the second lower additional-folding rollers 262*a* and 262*b* to be in the press-releasing state.

Figure 18:
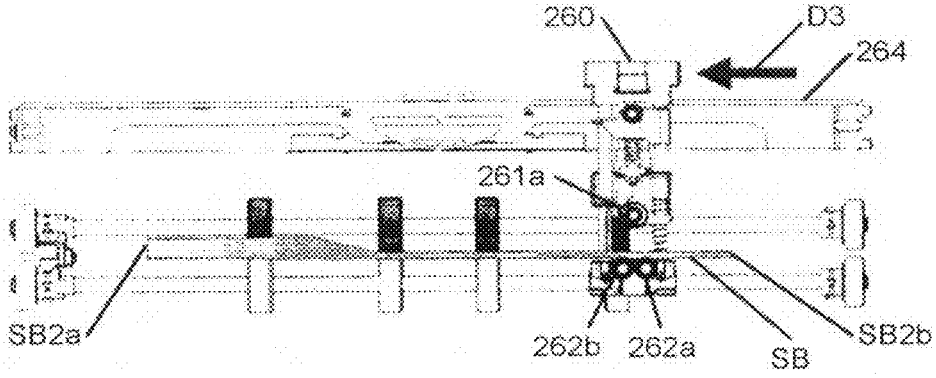
FIG. 18 is an operation explanatory diagram illustrating a state in which the additional-folding roller unit starts backward movement from the final position of the forward movement.
Figure 19:
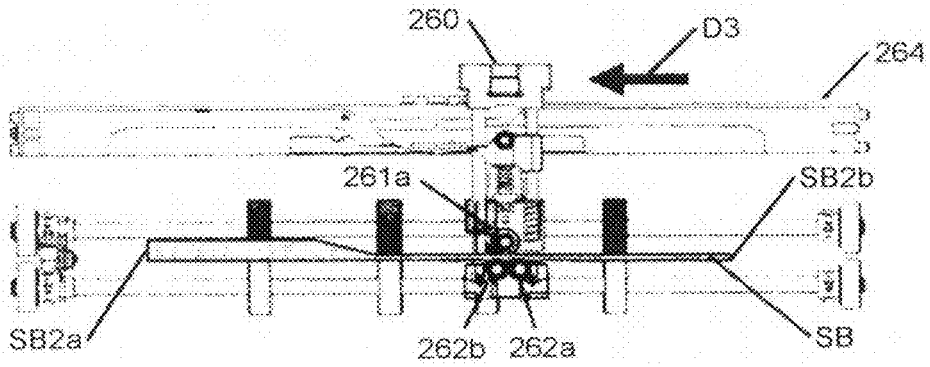
FIG. 19 is an operation explanatory diagram illustrating a state in which the additional-folding roller unit starts backward movement and reaches a sixth guiding path.
Figure 20:
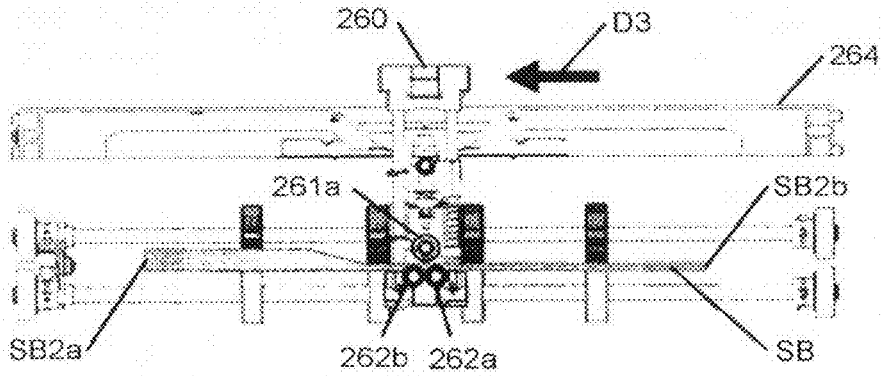
FIG. 20 is an operation explanatory diagram illustrating a state in which the additional-folding roller unit reaches the sixth guiding path and shifts from a press-releasing state to a pressing state.
Figure 21:
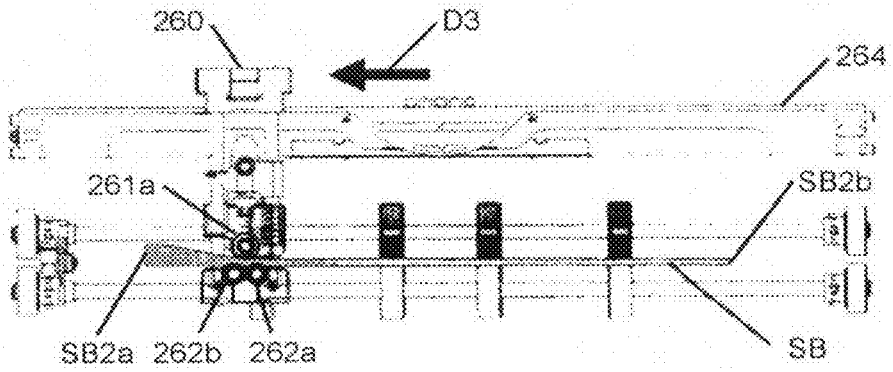
FIG. 21 is an operation explanatory diagram illustrating a state of completely pressing state when the additional-folding roller unit enters a fifth guiding path.

Subsequently, the additional-folding roller unit 260 starts to move backward with the unit moving mechanism 263 (FIG. 18). In the backward movement, the pressing mechanism 265 moves along the fourth guiding path 274 in the left direction of the figure (direction of the arrow D3). When the pressing mechanism 265 reaches the sixth guiding path 276 due to this movement (FIG. 19), the guide pin 265*a* is pushed downward along the shape of the sixth guiding path 276, and the pressing mechanism 265 is shifted from the press-releasing state to the pressing state (FIG. 20).

Figure 22:
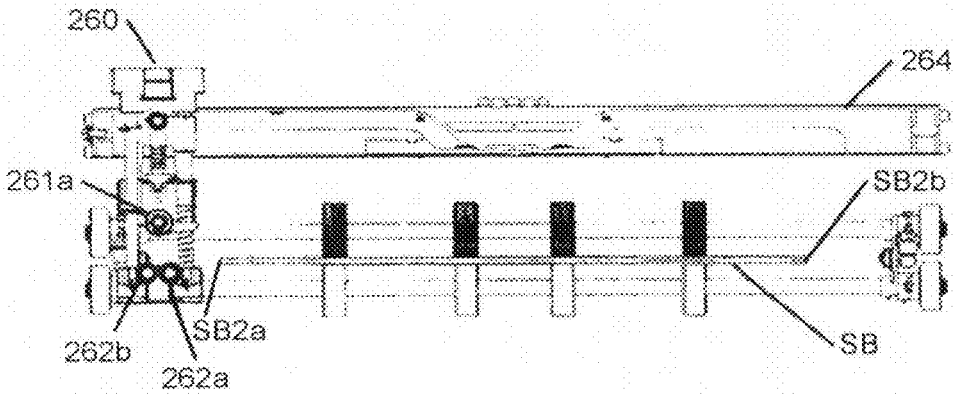
FIG. 22 is an operation explanatory diagram illustrating a state in which the additional-folding roller unit moves in the fifth guiding path as it is and returns to an initial position.

When entering the fifth guiding path 275, the pressing mechanism 265 is in a completely pressing state, and moves through the fifth guiding path 275 as it is in the direction of the arrow D3 (FIG. 21) to pass through the center-folded sheet bundle SB (FIG. 22).

The additional-folding roller unit 260 is reciprocated as described above to additionally fold the fold line part SB1 of the center-folded sheet bundle SB. In this case, the additional-folding roller unit 260 starts additional-folding from the center part of the center-folded sheet bundle SB to one side, and passes through one end SB2b of the center-folded sheet bundle SB. After that, additional-folding is performed such that the additional-folding roller unit 260 passes over the additionally folded part of the center-folded sheet bundle SB, starts additional-folding from the center part of the center-folded sheet bundle SB to the other side, and passes through the other end SB2a.

With such an operation, the upper additional-folding roller 261*a* and the first and the second lower additional-folding rollers 262*a* and 262*b* do not come into contact with or pressurize each of the ends SB2a and SB2b of the center-folded sheet bundle SB from the outside of the center-folded sheet bundle SB when the additional-folding is started or when the additional-folding roller unit 260 passes through one end SB2b and returns to the other end SB2a. That is, when passing through the ends SB2a, SB2b of the center-folded sheet bundle SB from the outside of the end, the additional-folding roller unit 260 is in the press-releasing state. Due to this, no damage is caused to the ends SB2a and SB2b of the center-folded sheet bundle SB. Because the additional-folding is performed from near the center part of the center-folded sheet bundle SB toward the end SB2a or SB2b, a distance of traveling on the center-folded sheet bundle SB in a contact manner becomes short in additional-folding, so that twists that cause wrinkles and the like are hardly accumulated. Accordingly, no damage is caused to the ends SB2a and SB2b of the center-folded sheet bundle SB when the fold line part (spine) SB1 of the center-folded sheet bundle SB is additionally folded, so that it is possible to prevent curling up or wrinkles from being caused at the fold line part SB1 and the vicinity thereof due to accumulation of twists.

To prevent the upper additional-folding roller 261*a* and the first and the second lower additional-folding rollers 262*a* and 262*b* from running onto the end SB2a or SB2b from the outside of the end SB2a or SB2b of the center-folded sheet bundle SB, the operation is performed as shown by FIG. 12 to FIG. 22. That is, as shown in FIG. 12, when La represents a distance by which the additional-folding roller unit 260 moves over the center-folded sheet bundle in the press-releasing state in forward movement, and Lb represents a distance by which the additional-folding roller unit 260 moves over the center-folded sheet bundle SB in the press-releasing state in backward movement, a relation between the length L in the width direction of the center-folded sheet bundle and the distances La and Lb needs to satisfy L>La+Lb (FIG. 12 to FIG. 14, and FIG. 17 to FIG. 19).

It is preferable that the distances La and Lb are set to be substantially the same, and pressing is started near the center part in the width direction of the center-folded sheet bundle SB (FIG. 16 and FIG. 20).

In the additional-folding roller unit 260 according to the embodiment, the upper additional-folding roller unit 261 is configured to be movable in the vertical direction and the lower additional-folding roller unit 262 is configured not to be movable in the vertical direction. Alternatively, the lower additional-folding roller unit 262 can also be configured to be movable in the vertical direction. With such a configuration, the upper additional-folding roller 261*a* and the first and the second lower additional-folding rollers 262*a* and 262*b* symmetrically perform a contacting/separating operation with respect to the additional-folding position. Accordingly, the additional-folding position is constant regardless of the thickness of the center-folded sheet bundle SB, so that the damage such as a scratch can be further prevented.

Figure 23:
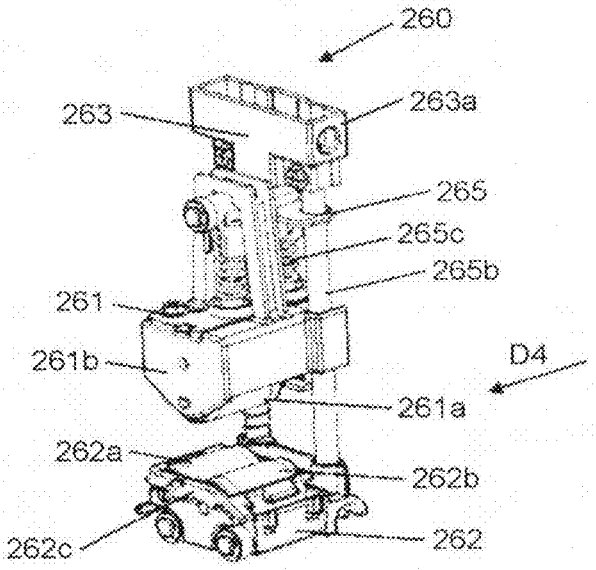
FIG. 23 is a perspective view illustrating a detailed configuration of the additional-folding roller unit according to the embodiment of the present invention.
Figure 24:
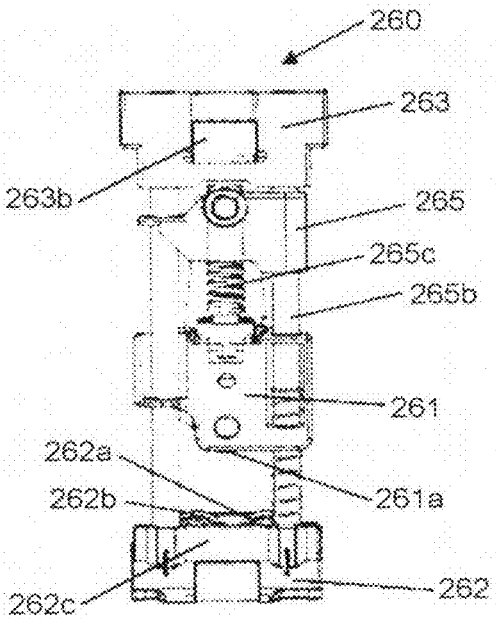
FIG. 24 is a diagram illustrating the additional-folding roller unit of FIG. 23 viewed from a direction of the arrow D4.

FIG. 23 is a perspective view illustrating a detailed configuration of the additional-folding roller unit 260, and FIG. 24 is a diagram illustrating the additional-folding roller unit 260 of FIG. 23 viewed from a direction of the arrow D4.

The upper additional-folding roller 261*a* is rotatably supported by an upper roller holder 261*b* on the upper additional-folding roller unit 261 side, and the first and the second lower additional-folding rollers 262*a* and 262*b* are rotatably supported by a lower roller holder 262*c* on the lower additional-folding roller unit 262 side. The unit moving mechanism 263 includes a slider member 263*a*, and the slider member 263*a* is engaged with a timing belt (not illustrated) at a timing belt engaging part 263*b*. Accordingly, when the timing belt is driven by a motor (not illustrated), the unit moving mechanism 263 moves in the width direction of the center-folded sheet bundle SB in synchronization with movement of the timing belt.

As described above, the upper additional-folding roller unit 261 is supported to be movable in the vertical direction (sheet thickness direction t: refer to FIG. 26) by the unit moving mechanism 263 with the support member 265*b*, and the lower additional-folding roller unit 262 is mounted to the lower end of the support member 265*b* of the pressing mechanism 265 so as not to be movable. That is, the first and the second lower additional-folding rollers 262*a* and 262*b* are mounted to the lower roller holder 262*c* so as not to be movable in the sheet thickness direction t, and the upper additional-folding roller 261*a* is mounted to the upper roller holder 261*b* so as to be movable in the sheet thickness direction t.

Figure 25:
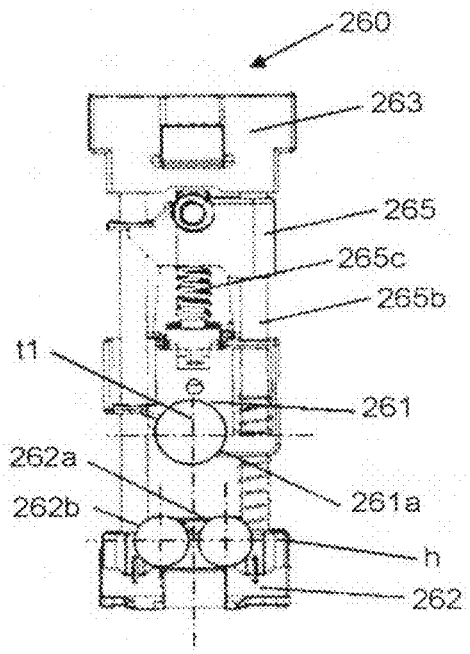
FIG. 25 is a diagram illustrating the additional-folding roller unit in which axial cores (rotation axes) of first and second lower additional-folding rollers are shifted in a sheet width direction with respect to an upper additional-folding roller.

In the embodiment, as illustrated in FIG. 25, the axial cores (rotation axes) of the first and the second lower additional-folding rollers 262*a* and 262*b* are shifted in the sheet width direction of the center-folded sheet bundle SB with respect to the upper additional-folding roller 261*a* as compared with the basic configuration of the additional-folding roller unit 260 illustrated in FIG. 7. The shift in the sheet width direction is a shift of a perpendicular (line t1 in the sheet thickness direction) taken down from a rotation center of the upper additional-folding roller 261*a* to a line connecting rotation centers of the first and the second lower additional-folding rollers 262*a* and 262*b* in a direction h orthogonal to the sheet thickness direction t (direction parallel to the moving direction of the additional-folding roller unit 260). This shift amount is represented as δ in FIG. 27.

The shift δ is a shift between the rotation axes of the upper additional-folding roller 261*a* and the first and the second lower additional-folding rollers 262*a* and 262*b* in the moving direction of the additional-folding roller unit 260.

Figure 26:
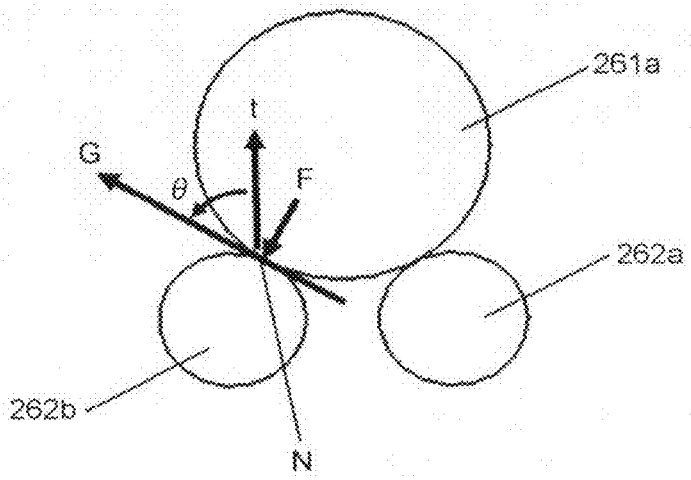
FIG. 26 is a schematic diagram illustrating a pressing state in which a fold line part of the sheet bundle is pressed with the upper additional-folding roller and the first and the second lower additional-folding rollers.

FIG. 26 is a schematic diagram illustrating a pressing state in which the fold line part SB1 of the center-folded sheet bundle SB is pressed with the upper additional-folding roller 261*a* and the first and the second lower additional-folding rollers 262*a* and 262*b*. In the embodiment, a direction of a tangent G to a nip N between the upper additional-folding roller 261*a* and the first lower additional-folding roller 262*a* is not parallel to a direction orthogonal to the thickness direction t of the center-folded sheet bundle SB. More specifically, when an angle with respect to the thickness direction t of the center-folded sheet bundle SB is assumed to be θ, 0°<θ<90° is satisfied.

Preferably, the angle θ is as follows: 60°<θ<90°.

Figure 27:
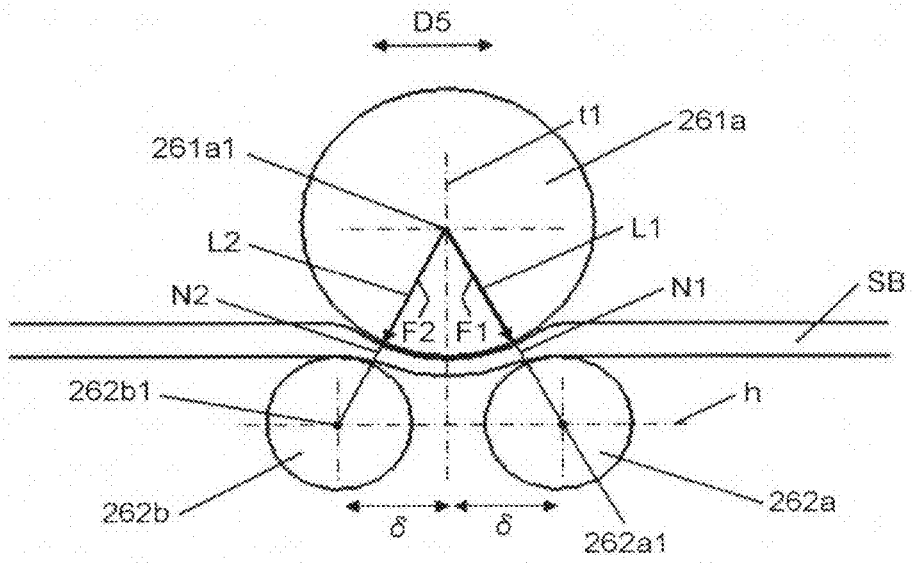
FIG. 27 is an enlarged view illustrating a pressed portion between the upper additional-folding roller and the first and the second lower additional-folding rollers.

A pressing force F generated between the upper additional-folding roller 261*a* and the first lower additional-folding roller 262*a* is in a direction orthogonal to the direction of the tangent G described above, so that the direction of the pressing force F is inclined with respect to the thickness direction t of the center-folded sheet bundle SB. Accordingly, as illustrated in the enlarged view of the pressed portion in FIG. 27, a force is generated for displacing the spine (fold line part SB1) of the center-folded sheet bundle SB in the thickness direction t of the center-folded sheet bundle SB. Due to this, as compared to a case in which a pressing force is generated in the thickness direction of the center-folded sheet bundle SB (θ=90 deg), a folding height (additional-folding effect) corresponding to a certain pressing force can be reduced. This force similarly acts on between the upper additional-folding roller 261*a* and the second lower additional-folding roller 262*b*. The direction of the force is, as illustrated in FIG. 27, symmetrical to the line t1 taken down from a rotation center 261*a*1 of the upper additional-folding roller 261*a* in the thickness direction t of the center-folded sheet bundle SB. This is because the first and the second lower additional-folding rollers 262*a* and 262*b* are arranged symmetrically with respect to the line t1.

That is, in the embodiment, the pressing force F1 acts along a first line L1 connecting the center 261*a*1 of the upper additional-folding roller 261*a* and the center 262*a*1 of the first lower additional-folding roller 262*a*, and the pressing force F2 acts along a second line L2 connecting the center 261*a*1 of the upper additional-folding roller 261*a* and the center 262*b*1 of the second lower additional-folding roller 262*b*. In this case, the direction of the pressing forces F1, F2 are shifted from the thickness direction t of the center-folded sheet bundle SB, so that forces for bending the fold line part SB1, in other words, forces in a bending direction are applied to the fold line part SB1 in addition to the pressing forces F1, F2. Fibers of the sheet are stretched or cut due to the force in the bending direction and the sheet bundle is pressed in this state. Accordingly, the thickness of the fold line part SB1 can be reduced as compared to a case in which the sheet bundle SB is pressed only in the thickness direction t (θ=90 deg). A line h connecting the centers 262*a*1 and 262*b*1 of the first and the second lower additional-folding rollers 262*a* and 262*b* is orthogonal to the line t1 in the thickness direction of the center-folded sheet bundle SB and parallel to the sheet width direction.

The angle θ is changed depending on the thickness of the center-folded sheet bundle SB. That is, the shift amount δ in the sheet width direction is constant, the distances between the center 261*a*1 and the centers 262*a*1 and 262*b*1 are reduced when the thickness of the sheet bundle SB is small, and the distances are increased when the thickness is large, so that the angle θ is reduced in the former case. This changes pressing forces F1 and F2 generated in nips N1 and N2 between the upper additional-folding roller 261*a* and the first and the second lower additional-folding rollers 262*a* and 262*b*, respectively.

In other words, regarding the angle θ set as described above, the direction of the tangent G at the nip N position is shifted with respect to the carrying direction (direction of the arrow D5) of the additional-folding roller unit 260. "Shifted" means that the direction is inclined or not parallel to the carrying direction (direction of the arrow D5) of the additional-folding roller unit 260.

Figure 30:
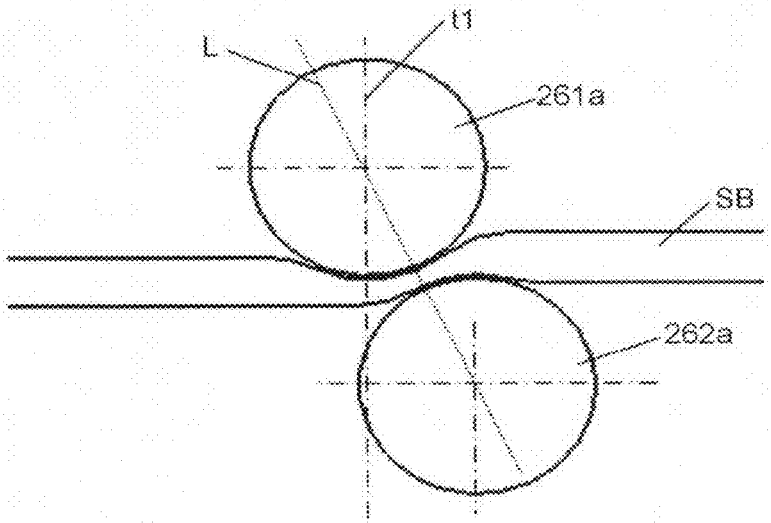
FIG. 30 is a diagram illustrating an example in which a shift amount is set between the upper additional-folding roller and the lower additional-folding roller, and a pressing force is generated in a direction inclined with respect to the thickness direction of the sheet bundle.

As described above, when the directions of the pressing forces F1 and F2 are shifted from the thickness direction t of the center-folded sheet bundle SB, the force for bending the fold line part SB1, in other words, the forces in the bending direction are applied to the fold line part SB1 in addition to the pressing forces F1 and F2. Due to this, the thickness of the fold line part SB1 can be reduced as compared to the case in which the center-folded sheet bundle SB is pressed only in the thickness direction t (θ=90 deg). This effect can be exhibited by inclining a line L connecting axes of two additional-folding rollers against (the line t1 drawn in) the thickness direction t of the center-folded sheet bundle SB as illustrated in FIG. 30, for example. However, as illustrated in FIG. 27, the number of positions for bending the sheet bundle SB can be doubled if the configuration includes three rollers, that is, the upper additional-folding roller 261*a* and the first and the second lower additional-folding rollers 262*a* and 262*b* opposed thereto. As a result, a thickness reducing effect is obviously further improved.

The sheet bundle SB can be bent by the axis shift amount uniformly on the right and left in the moving direction (width direction of the sheet bundle: direction of the arrow D1) of the additional-folding roller unit 260. In the embodiment, one side is additionally folded in the forward movement and the other side is additionally folded in the backward movement. By uniformly bending on the right and left, outputs from the driving source for the forward movement and the backward movement can be made the same, so that a control configuration is simplified.

In the embodiment, the upper additional-folding roller 261*a* and the first and the second lower additional-folding rollers 262*a* and 262*b* are rotatably configured to roll over and pressurize both faces of the sheet bundle SB to be additionally folded. Alternatively, the sheet bundle SB can be pressurized with a fixed member instead of the roller. However, in this case, an outer shape of the fixed member should be curved surface as illustrated in FIG. 27 to generate the pressing force F in a direction inclined with respect to the thickness direction of a booklet. When the pressing force F is generated with the fixed member in the direction inclined with respect to the thickness direction of the booklet, a load for moving the fixed member in the sheet width direction is increased. To reduce the load, it is preferable to use a rolling member such as the roller as in the embodiment.

Figure 28:
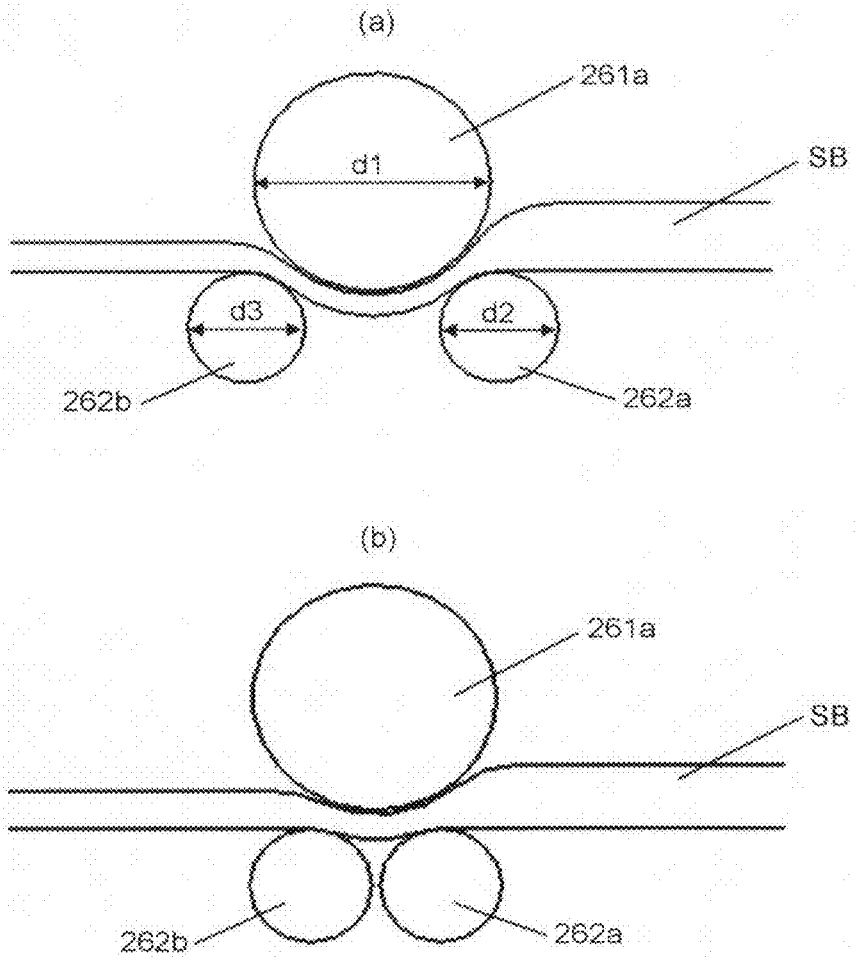
FIG. 28(*a*) is a diagram illustrating a positional relation between the upper additional-folding roller and the first and the second lower additional-folding rollers when the sheet bundle is strongly bent.

Regarding the upper additional-folding roller 261*a* and the first and the second lower additional-folding rollers 262*a* and 262*b*, as shown in FIG. 28(*a*), diameters d2 and d3 of the first and the second lower additional-folding rollers 262*a* and 262*b* are preferably made smaller than a diameter d1 of the upper additional-folding roller 261*a*. By making the diameters d2 and d3 smaller than the diameter D1, the additional-folding roller unit 260 can be downsized. In the embodiment, the relation among the diameters d1, d2, and d3 is made as described above because the rollers are used. When the fixed member having the curved surface is used, a dimensional relation in the width direction of the center-folded sheet bundle SB may be made the same as a dimensional relation of the diameters.

The embodiment may also be configured so as to be able to change the shift amount δ of the first and the second lower additional-folding rollers 262*a* and 262*b* from the upper additional-folding roller 261*a*. If the shift amount δ can be changed as described above, folding strength can be controlled by deformation of the sheet bundle SB due to the shift amount δ and the pressurizing force. For example, the folding strength can be increased when the number of sheets is large, and the folding strength can be reduced when the number of sheets is small. The folding strength can be reduced at a portion of a staple needle to prevent deformation of the staple needle or prevent damage to a folding roller. FIG. 28(*a*)

illustrates the positions of the first and the second lower additional-folding rollers 262*a* and 262*b* when the center-folded sheet bundle SB is strongly bent. FIG. 28(*b*) illustrates the positions of the first and the second lower additional-folding rollers 262*a* and 262*b* when the center-folded sheet bundle SB is weakly bent. When the shift amount δ can be changed as described above, the pressurizing force to the center-folded sheet bundle SB, that is, bending of the sheets can be controlled with a simple configuration while keeping the same energizing unit 265*c*.

Figure 29:
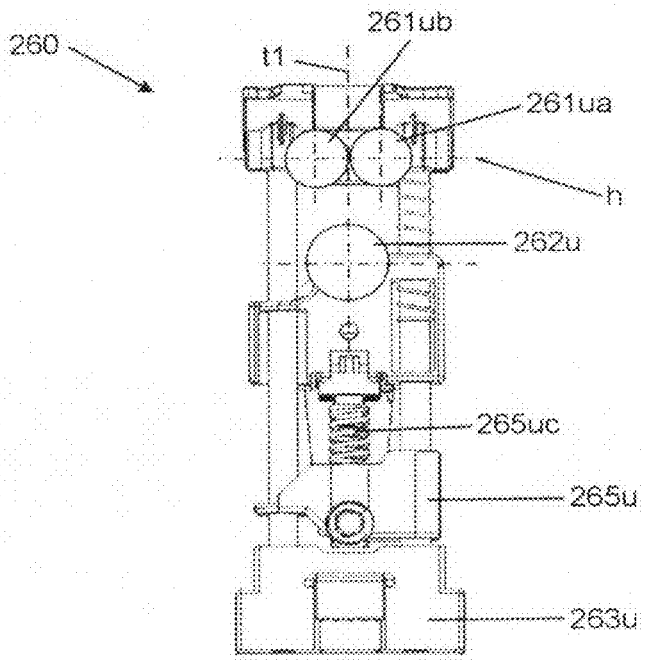
FIG. 29 is a diagram illustrating an example of the additional-folding roller in which an upper and lower relation is replaced between the upper additional-folding roller and the first and the second lower additional-folding rollers.

In the embodiment described above, the upper additional-folding roller 261*a* is arranged above the center-folded sheet bundle SB, and the first and the second lower additional-folding rollers 262*a* and 262*b* are arranged below the center-folded sheet bundle SB. Alternatively, as shown in FIG. 29, two rollers 261*ua* and 261*ub* may be arranged above the center-folded sheet bundle and one roller 262*u* may be arranged below the center-folded sheet bundle to obtain the same effect. The additional-folding roller unit 260 illustrated in FIG. 29 is configured such that the additional-folding roller unit 260 illustrated in FIG. 25 is turned upside down, and a unit moving mechanism 263*u*, a pressing mechanism 265*u*, a pressurizing spring 265*uc*, and the like are reversely arranged. However, these mechanisms are not necessarily reversed. The example of FIG. 29 is exemplary only.

Figure 31:
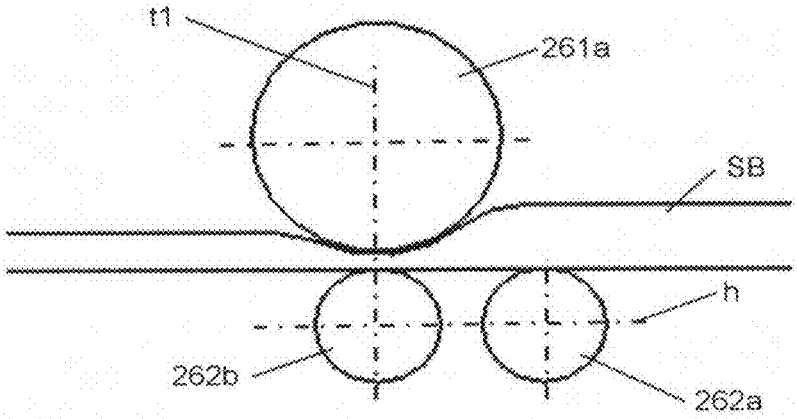
FIG. 31 is a diagram illustrating an example in which the shift amount is set to 0 between the upper additional-folding roller and the second lower additional-folding roller.

The following configuration can be made as a development of the embodiment described above. The above embodiment is configured so as to be able to change the shift amount δ of the first and the second lower additional-folding rollers 262*a* and 262*b* from the upper additional-folding roller 261*a*. Accordingly, as illustrated in FIG. 31, deformation of the fold line part can be prevented when the shift amount δ between the second lower additional-folding roller 262*b* and the upper additional-folding roller 261*a* satisfies δ=0. The folding strength can be reduced in a case in which the number of sheets is small, or in a case of preventing damage to the folding roller or deformation of the staple needle at the portion of the staple needle.

Figure 32:
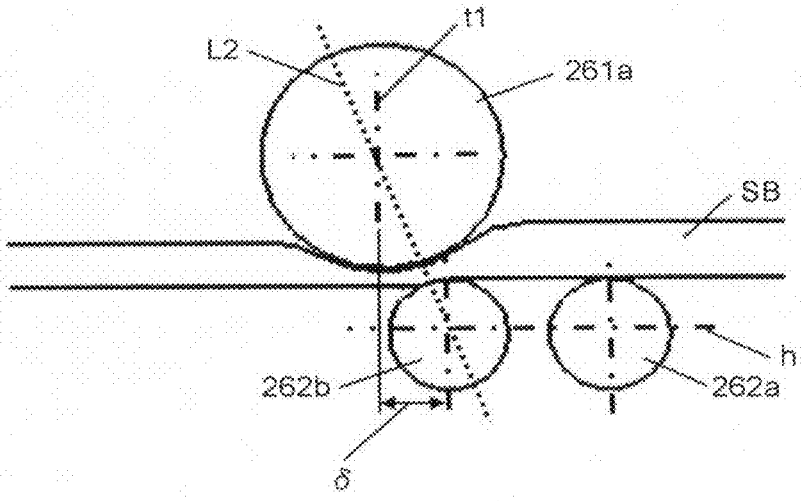
FIG. 32 is a diagram illustrating an example in which a predetermined shift amount is set between the upper additional-folding roller and the second lower additional-folding roller.

Selection mode of additional-folding strength can be increased to improve convenience of a user. That is, the same effect as in the case of including two rollers in FIG. 30 can be obtained with three rollers. Specifically, any of the first and the second lower additional-folding rollers 262*a* and 262*b* is configured to be released in the sheet thickness direction t. Alternatively, the upper additional-folding roller 261*a* is configured to be arranged externally with respect to any of the first and the second lower additional-folding rollers 262*a* and 262*b* (FIG. 32). Accordingly, similarly to the case in FIG. 30, the sheet bundle SB is pressurized and additionally folded by inclining, with respect to the thickness direction t of the sheet bundle, the direction of the tangent to the nip between two rollers, that is, the upper additional-folding roller 261*a* and the second lower additional-folding roller 262*b* in FIG. 32.

In this way, it is possible to control the pressurizing force to the center-folded sheet bundle, that is, the bending of the sheets with a simple configuration.

As described above, the following effects are exhibited according to the embodiment.

(1) The sheet processing device includes pressing means for holding and pressing the fold line part SB1 of the center-folded sheet bundle SB and the additional-folding roller unit 260 (moving means) for moving the pressing position of the pressing means in a fold direction (direction of the arrow D1) of the sheet bundle SB. The pressing means includes the upper additional-folding roller 261*a* (first pressing roller) arranged on one side of the thickness direction of the sheet bundle SB and the first and the second lower additional-folding rollers 262*a* and 262*b* (second and third pressing roller) arranged on the other side across the fold line part SB1 of the center-folded sheet bundle SB. The first line L1 connects the center 261*a*1 of the upper additional-folding roller 261*a* (first pressing roller) and the center 262*a*1 of the first lower additional-folding roller 262*a* (second pressing roller), and the second line L2 connects the center 262*a*1 of the upper additional-folding roller 261*a* (first pressing roller) and the center 262*b*1 of the second lower additional-folding roller 262*b* (third pressing roller). The additional-folding roller unit 260 (moving means) causes a state in which each of the first line L1 and the second line L2 is not parallel to the thickness direction t of the center-folded sheet bundle SB, and moves the upper additional-folding roller 261*a* and the first and the second lower additional-folding rollers 262*a* and 262*b* (the first, the second, and the third pressing roller) in the width direction (direction of the arrow D1) of the sheet bundle SB. Accordingly, additional-folding can be performed with a small pressurizing force and the size and the cost of the device can be reduced.

This is because the upper additional-folding roller 261*a* that presses the upper surface of the center-folded sheet bundle SB and the first and the second lower additional-folding rollers 262*a* and 262*b* that press the lower surface of the center-folded sheet bundle SB are arranged so that each of the first and the second lines L1 and L2 connecting the respective centers of the upper and lower rollers is not in parallel to the thickness direction t of the center-folded sheet bundle SB, in other words, the centers 262*a*1 and 262*b*1 of the first and the second lower additional-folding rollers 262*a* and 262*b* are shifted from the center 261*a*1 of the upper additional-folding roller 261*a* in the sheet width direction. With such an arrangement, when the sheet bundle SB is held among the three additional-folding rollers 261*a*, 262*a*, and 262*b*, the fold line part SB1 of the center-folded sheet bundle SB can be additionally folded while causing mountain-shaped deformation with the three additional-folding rollers 261*a*, 262*a*, and 262*b*. As a result, the additional-folding effect can be obtained with a smaller force than that in the case of simply compressing the sheet bundle SB.

(2) The upper additional-folding roller 261*a* (first pressing roller) is positioned between the first and the second lower additional-folding rollers 262*a* and 262*b* (second and third pressing rollers) in the width direction (direction of the arrow D1) of the sheet bundle SB (refer to FIG. 27 and FIGS. 28(*a*), 28(*b*)), so that the center-folded sheet bundle SB can be deformed in a mountain-shape (V-shape) and a force in the bending direction can also be applied to the fold line part SB1 of the center-folded sheet bundle SB. Due to the force in the bending direction, the thickness of the fold line part SB1 can be reduced as compared to the case of pressing the center-folded sheet bundle SB only in the thickness direction t.

(3) The shift amount δ of the center 262*a*1 position of the first lower additional-folding roller 262*a* (second pressing roller) from the line t1 drawn from the center 261*a*1 of the upper additional-folding roller 261*a* (first pressing roller) in the thickness direction t of the sheet bundle SB is the same as the shift amount δ of the center 262*b*1 position of the second lower additional-folding roller 262*b* (third pressing roller) from the line t1 (FIG. 27), so that additional-folding can be performed while uniformly bending on the right and left when one side is additionally folded in the forward movement and the other side is additionally folded in the backward movement. Accordingly, outputs from the driving source for the forward movement and the backward movement can be made the same, so that the control configuration is simplified.

(4) Each of the diameters d2 and d3 (dimension in the sheet width direction) of the first and the second lower additional-folding rollers 262*a* and 262*b* (the second pressing roller and the third pressing roller) is smaller than the diameter d1 (dimension in the sheet width direction) of the upper additional-folding roller 261*a* (first pressing roller), so that the additional-folding roller unit 260 can be downsized.

(5) The first lower additional-folding roller 262*a* or the second lower additional-folding roller 262*b* (the second pressing roller or the third pressing roller) is movable in the sheet width direction (direction of the arrow D1) with respect to the upper additional-folding roller 261*a* (first pressing roller), so that it is possible to change the shift amount δ of the first and the second lower additional-folding rollers 262*a* and 262*h* from the upper additional-folding roller 261*a*. Accordingly, the folding strength can be controlled by deformation of the center-folded sheet bundle SB due to the shift amount δ and the pressurizing force.

(6) The first lower additional-folding roller 262*a* or the second lower additional-folding roller 262*b* (the second pressing roller or the third pressing roller) is movable to the same position in the sheet width direction (position over the line t1 drawn from the center 261*a*1 of the upper additional-folding roller 261*a* in the thickness direction t of the center-folded sheet bundle SB) with respect to the upper additional-folding roller 261*a* (first pressing roller), so that pressing can be performed with a shift amount 0 even though the pressing has been conventionally performed with a predetermined shift amount δ other than 0 (refer to FIG. 31). Accordingly, additional-folding can be performed in a mode in which the folding strength is weak, and options for the folding strength can be increased.

(7) The upper additional-folding roller 261*a* (the first pressing roller) is arranged externally with respect to the first lower additional-folding roller 262*a* or the second lower additional-folding roller 262*b* (the second pressing roller or the third pressing roller) in the sheet width direction (refer to FIG. 32), so that additional-folding can be performed with two rollers, that is, two upper and lower additional-folding rollers 261*a* and 262*b* (or 262*a*). Accordingly, options for the folding strength can be increased.

(8) The guiding path 270 that includes the first to sixth guiding paths 271 to 276 for causing the upper additional-folding roller 261*a* (first pressing roller) and the first and the second lower additional-folding rollers 262*a* and 262*b* (second and third pressing rollers) to be in the pressing state and the press-releasing state is provided, so that deformation of the rollers can be prevented by causing the press-releasing state when the additional-folding operation is not performed.

(9) An image forming system that includes the image forming apparatus PR and the sheet postprocessing devices (sheet processing devices 1 and 2) described in the above (1) to (8) is provided, so that the image forming system can exhibit the effects of the above (1) to (8).

(10) The upper additional-folding roller 261*a* (first pressing roller) is arranged on one side of the thickness direction t of the center-folded sheet bundle SB, and the first and the second lower additional-folding rollers 262*a* and 262*b* (second and third pressing rollers) are arranged on the other side of the thickness direction t of the center-folded sheet bundle SB. The fold line part SB1 of the center-folded sheet bundle SB is held between the upper additional-folding roller 261*a* (first pressing roller) and the first and the second lower additional-folding rollers 262*a* and 262*b* (second and third pressing rollers). The first line L1 connects the center 261*a*1 of the upper additional-folding roller 261*a* (first pressing roller) and the center 262*a*1 of the first lower additional-folding roller 262*a* (second pressing roller), and the second line L2 connects the center 262*a*1 of the upper additional-folding roller 261*a* (first pressing roller) and the center 262*b*1 of the second lower additional-folding roller 262*b* (third pressing roller). The additional-folding roller unit 260 (moving means) causes a state in which each of the first line L1 and the second line L2 is not parallel to the thickness direction t of the center-folded sheet bundle SB, and moves the upper additional-folding roller 261*a* and the first and the second lower additional-folding rollers 262*a* and 262*b* (the first, the second, and the third pressing rollers) in the width direction of the center-folded sheet bundle to additionally fold the fold line part SB1 of the center-folded sheet bundle SB. Accordingly, additional-folding can be performed with a small pressurizing force and the size and the cost of the device can be reduced.

In the description of the effects of the embodiment, each component to be described in the scope of claims corresponding to each unit in the embodiment is put in brackets, or denoted by a reference numeral, to clarify the correspondence relation therebetween. According to the present invention, additional-folding can be performed with a small pressurizing force and the size and the cost of the device can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device comprising:

a pressing device that presses a fold line part of a folded sheet bundle; and a moving device that moves a pressing position of the pressing device in a fold direction of the folded sheet bundle, wherein the pressing device includes a first pressing roller arranged on one side of a thickness direction of the folded sheet bundle, and a second pressing roller and a third pressing roller arranged on another side across the fold line part of the folded sheet bundle, the pressing device is arranged in a state in which each of a first line and a second line is not parallel to the thickness direction of the folded sheet bundle, the first line connecting a rotational center of the first pressing roller and a rotational center of the second pressing roller, and the second line connecting the rotational center of the first pressing roller and a rotational center of the third pressing roller, the second pressing roller and the third pressing roller are movable such that a distance between the rotational center of the second pressing roller and the rotational center of the third pressing roller changes only in the fold direction, and the fold direction is orthogonal to the thickness direction.

2. The sheet processing device according to claim 1, wherein the first pressing roller is positioned between the second pressing roller and the third pressing roller in the fold direction of the folded sheet bundle.

3. The sheet processing device according to claim 1, wherein a shift amount of the rotational center position of the second pressing roller from a line drawn from the rotational center of the first pressing roller in the thickness direction of the folded sheet bundle is a same as a shift amount of the rotational center position of the third pressing roller from the line.

4. The sheet processing device according to claim 1, wherein each of dimensions of the second pressing roller and the third pressing roller in the fold direction is smaller than a dimension of the first pressing roller in the fold direction.

5. The sheet processing device according to claim 1, wherein the second pressing roller or the third pressing roller is movable in the fold direction with respect to the first pressing roller.

6. The sheet processing device according to claim 5, wherein the second pressing roller or the third pressing roller is movable to a same position in the fold direction with respect to the first pressing roller.

7. The sheet processing device according to claim 5, wherein the first pressing roller is arranged upstream or downstream with respect to the second pressing roller or the third pressing roller in the fold direction.

8. The sheet processing device according to claim 1, further comprising a pressing state changing device that causes the pressing device to be in a pressing state and a press-releasing state.

9. An image forming system including a sheet processing device, the sheet processing device comprising:

a pressing device that presses a fold line part of a folded sheet bundle, a moving device that moves a pressing position of the pressing device in a fold direction of the folded sheet bundle, and the pressing device includes a first pressing roller arranged on one side of a thickness direction of the folded sheet bundle, and a second pressing roller and a third pressing roller arranged on another side across the fold line part of the folded sheet bundle, and the pressing device is arranged in a state in which each of a first line and a second line is not parallel to the thickness direction of the folded sheet bundle, the first line connecting a rotational center of the first pressing roller and a rotational center of the second pressing roller, and the second line connecting the rotational center of the first pressing roller and a rotational center of the third pressing roller, wherein the second pressing roller and the third pressing roller are movable such that a distance between the rotational center of the second pressing roller and the rotational center of the third pressing roller changes only in the fold direction, and the fold direction is orthogonal to the thickness direction.

10. A method of additionally folding a folded sheet bundle, comprising:

arranging a first pressing roller on one side of a thickness direction of the folded sheet bundle, and arranging a second pressing roller and a third pressing roller on another side of the thickness direction of the folded sheet bundle;

holding a fold line part of the folded sheet bundle between the first pressing roller and the second and the third pressing rollers;

moving the first, the second, and the third pressing rollers in a fold direction of the folded sheet bundle to additionally fold the fold line part of the folded sheet bundle in a state in which each of a first line and a second line is not parallel to the thickness direction of the folded sheet bundle, the first line connecting a rotational center of the first pressing roller and a rotational center of the second pressing roller, and the second line connecting the rotational center of the first pressing roller and a rotational center of the third pressing roller; and moving the second pressing roller and the third pressing roller such that a distance between the rotational center of the second pressing roller and the rotational center of the third pressing roller changes only in the fold direction, wherein the fold direction is orthogonal to the thickness direction.

* * * * *